United States Patent [19]

Emark, Jr.

[11] 4,072,885

[45] Feb. 7, 1978

[54] CONTROL SYSTEM AND METHOD FOR REMOVAL OF COKE FROM A COKE OVEN

[75] Inventor: Lawrence W. Emark, Jr., McCandless Township, Pittsburgh County, Pa.

[73] Assignee: Westinghouse Electric Corporation, Pittsburgh, Pa.

[21] Appl. No.: 628,441

[22] Filed: Nov. 3, 1975

[51] Int. Cl.[2] ..... C10B 35/00

[52] U.S. Cl. ..... 318/600; 214/23; 202/262

[58] Field of Search ..... 214/23, 26; 318/600, 318/601, 602, 603; 202/262

[56] References Cited

U.S. PATENT DOCUMENTS

| | | | |
|---|---|---|---|
| 2,828,481 | 3/1958 | Latapie | 214/23 X |
| 2,849,128 | 8/1958 | Sloss | 214/23 |
| 3,124,736 | 3/1964 | Randell | 214/23 X |
| 3,502,234 | 3/1970 | Cook | 214/26 |
| 3,562,514 | 3/1969 | Brand, Jr. | 318/52 |
| 3,897,311 | 7/1975 | Krenke | 214/23 X |

*Primary Examiner*—B. Dobeck
*Attorney, Agent, or Firm*—R. G. Brodahl

[57] ABSTRACT

A method and control apparatus are disclosed for providing incremental position regulation of industrial apparatus, and for synchronizing movement of the apparatus, where an illustration of such industrial apparatus could be a coke transfer hot car, moving along a track at the coke side of a coke oven chamber, in conjunction with the forward advancement of a pusher ram, in the direction of proceeding through a coking chamber from the pusher machine side thereof. The present method and control apparatus are characterized by generating pulses that are encoded to represent actual incremental position displacements of the pusher ram. These pulses are used in a feedback control loop for positioning and speed control for the ram, and the pulses are used by a central controller to produce signal pulses representing the desired displacement for the associated hot coke transfer car. The signal pulses are transmitted to control a drive system for the car, which is additionally controlled by a feedback control loop using car position pulses generated to represent the actual displacement of the car. The car position pulses are also transmitted to the central controller, where the signal pulses to the drive for the car are modified to establish and then maintain a steady-state position lag error and constant speed relationship between the ram and the car. The car position pulses are used in the central controller as a feedback control for permissive continued position advancement of the pusher ram.

27 Claims, 20 Drawing Figures

LOGICAL FORMS:

$f_5 = \bar{A}B + A\bar{B}$ (EXCL.OR.) $f_6 = \overline{AB} + AB$ (COINCIDENCE)

| A B | .AND. $f_1$ | NAND $f_2$ | .OR. $f_3$ | NOR $f_4$ | EXCL.OR. $f_5$ | COINCIDENCE $f_6$ |
|---|---|---|---|---|---|---|
| 0 0 | 0 | 1 | 0 | 1 | 0 | 1 |
| 0 1 | 0 | 1 | 1 | 0 | 1 | 0 |
| 1 0 | 0 | 1 | 1 | 0 | 1 | 0 |
| 1 1 | 1 | 0 | 1 | 0 | 0 | 1 |

RS FLIP-FLOP

| A B | $Q_A$ | $Q_B$ |
|---|---|---|
| 0 0 | 1 | 1 |
| 0 1 | 0 | 1 |
| 1 0 | 1 | 0 |
| 1 1 | $Q_A$ | $Q_B$ |

JK FLIP-FLOP

| n | | n±1 |
|---|---|---|
| K | J | Q |
| 0 | 0 | $Q^n$ |
| 0 | 0 | 1 |
| 1 | 0 | 0 |
| 1 | 1 | $\bar{Q}^n$ |

| P | $\Sigma Q_n$ | $\Sigma \bar{Q}_n$ | VALUE |
|---|---|---|---|
| | 1 1 1 1 | 0 0 0 0 | F |
| | 1 1 1 0 | 0 0 0 1 | E |
| | 1 1 0 1 | 0 0 1 0 | D |
| | 1 1 0 0 | 0 0 1 1 | C |
| | 1 0 1 1 | 0 1 0 0 | B |
| | 1 0 1 0 | 0 1 0 1 | A |
| | 1 0 0 1 | 0 1 1 0 | 9 |
| | 1 0 0 0 | 0 1 1 1 | 8 |
| | 0 1 1 1 | 1 0 0 0 | 7 |
| | 0 1 1 0 | 1 0 0 1 | 6 |
| | 0 1 0 1 | 1 0 1 0 | 5 |
| | 0 1 0 0 | 1 0 1 1 | 4 |
| | 0 0 1 1 | 1 1 0 0 | 3 |
| | 0 0 1 0 | 1 1 0 1 | 2 |
| | 0 0 0 1 | 1 1 1 0 | 1 |
| 0(+) | 0 0 0 0 | 1 1 1 1 | 0 |
| 1(-) | 0 0 0 1 | 1 1 1 0 | -1 |
| | 0 0 1 0 | 1 1 0 1 | -2 |
| | 0 0 1 1 | 1 1 0 0 | -3 |
| | 0 1 0 0 | 1 0 1 1 | -4 |
| | 0 1 0 1 | 1 0 1 0 | -5 |
| | 0 1 1 0 | 1 0 0 1 | -6 |
| | 0 1 1 1 | 1 0 0 0 | -7 |
| | 1 0 0 0 | 0 1 1 1 | -8 |
| | 1 0 0 1 | 0 1 1 0 | -9 |
| | 1 0 1 0 | 0 1 0 1 | -A |
| | 1 0 1 1 | 0 1 0 0 | -B |
| | 1 1 0 0 | 0 0 1 1 | -C |
| | 1 1 0 1 | 0 0 1 0 | -D |
| | 1 1 1 0 | 0 0 0 1 | -E |
| | 1 1 1 1 | 0 0 0 0 | -F |

CONTROL SYSTEM AND METHOD FOR REMOVAL OF COKE FROM A COKE OVEN

BACKGROUND OF THE INVENTION

This invention relates to controlling the movement of industrial apparatus such as a coke transfer hot car during the time while it is receiving hot coke from a coke oven in a synchronous relation with the movement of a pusher ram arranged at the other side of the coke oven to push the hot coke from the oven chamber. More particularly, the present invention relates to providing a control system based on a position dependent relationship which is established between position movements of such a coke transfer car at one side of a coke oven chamber with the position movements of such a coke pushing ram moving through the same coke oven chamber from the opposite side.

This invention is directed to the particular aspect in the operation of coke ovens involving the hot coke pushing and catching operations which are performed after the coking process has been completed, and is required, to empty a coke oven chamber, after which it receives another coal charge for the continued production of coke. Coke ovens are typically made up of a battery of oven chambers arranged in a side-by-side manner for the destructive distillation of coal. When the coking process has been completed in a given oven chamber, the doors fastened at opposite ends of the oven chamber are removed and a coke pushing ram is positioned, by a carriage movable along rails, so that the ram is aligned with the oven chamber for pushing the coke into a coke transfer car at the opposite coke side where there is typically employed a coke guide to direct the coke from the oven chamber into the hot car.

Attempts in the past have been made to control the movement of the coke transfer car while coke is being loaded therein so as to avoid the spillage of coke onto the area surrounding the transfer car. Additionally it is desirable to collect the coke at a substantially even depth in the coke transfer car so that at the end of the pushing operation, more uniform quenching of the hot coke can be achieved after transferring the car to a coke quenching station. At the quenching station, if the car contains irregular and radically changing depths of hot coke, far greater quantities of water are needed to quench the coke. Also, shallow depths of coke in the car become drenched which is undesirable.

In the past, control of the movements of the pusher ram and the hot coke transfer car during the actual coke pushing operations, sought to maintain a constant traverse speed of the coke transfer car, and cause the ram to move through the oven chamber in a controlled manner; e.g., at a constant speed, to push the coke into the coke transfer car. Should the ram stick or some other condition occur affecting the motion of the ram, the coke will not be pushed on the basis of a constant ram speed from the oven chamber during these periods of time, and consequently the transfer car will not receive coke as a uniform layer while the car continues to move at a constant speed. The coke transfer car may actually be moved beyond a point where it can receive coke from this oven chamber if some unforeseen critical delays to the movement of the pusher ram are encountered.

The present invention, therefore, seeks to provide an improved control based upon a position dependent and synchronous movement relation between the coke pushing ram and a hot coke transfer car so as to provide a layer of coke with a substantially uniform depth in the transfer car, and to avoid unnecessary spillage of coke.

SUMMARY OF THE INVENTION

In accordance with the present invention, an improved method and control system for coke pushing and catching operations are provided by detecting and using a signal corresponding to incremental forward displacements of the pusher ram through an oven chamber, for controlling and producing correlated incremental displacements of a coke transfer hot car at the opposite side of that same oven chamber, in a manner to achieve a steady-state position relationship between the displacement of the coke transfer hot car with respect to forward advancements of the pusher ram.

Specifically, the present invention provides a method and control system to synchronize and correlate the movement of a coke transfer hot car along a track at the coke discharge side of a given coke oven chamber, with the movement of a pusher ram advancing through that coke oven chamber from the opposite side thereof. Pulses are generated in response to movement of the ram which are encoded to represent the incremental movement and displacement direction of the ram. These pulses are used both in a return control loop for position and speed control of the ram, and the encoded pulses are used by a central controller to produce position control pulses representing the desired displacement of the coke transfer hot car. The position control pulses are transmitted to the drive for the coke transfer hot car, where they are used for position control of the transfer car. Signal pulses are generated by the movement of the coke transfer hot car that are used both in the return control loop for position control of the hot car, and the pulses are transmitted to the central controller where they are combined with the control pulses for the hot car to maintain a steady-state position and constant speed relation for movement of the hot car in relation to the pusher ram. The pulses generated upon movement of the hot car are used in a manner for permissive control to continue the advancement of the ram and the pushing of coke from the oven chamber.

The method of the present invention includes the steps of advancing a ram into contact with the coke at one side of an oven chamber and moving the coke to a point where it is about to embark from the opposite side of the oven into the waiting transfer car, and all the while inhibiting movement of a coke transfer car at the other side of the coke oven chamber: then advancing the coke transfer car along the track in a position dependent relationship to further advancing movement of the ram into the coke oven chamber for pushing coke into the transfer car; maintaining movement of the car along the track in the position relation dependent upon continued advancement of the ram through the coke oven chamber; terminating movement of the car along the track when the ram fails to continue forward advancement through the coke oven chamber; and stopping and retracting (after a short delay) the pusher ram, and stopping the forward advance of the transfer car if either drive fails to follow its respective reference signals within a preassigned error limit.

BRIEF DESCRIPTION OF THE DRAWINGS

The features and advantages of the present invention will become more apparent when the following description is read in relation to the accompanying drawings, in which.

DESCRIPTION OF THE PREFERRED EMBODIMENTS

Figure 1:
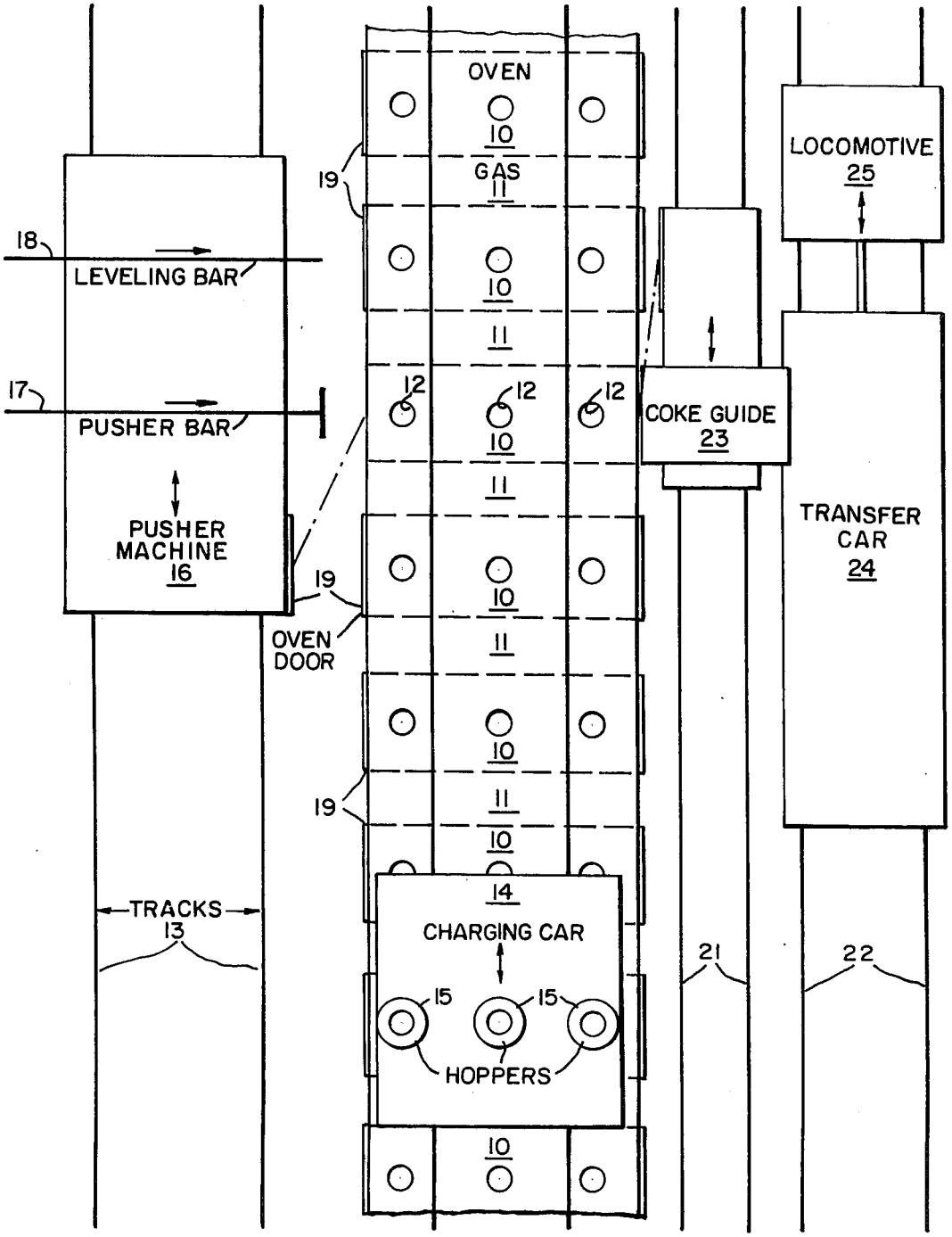
PRIOR ART FIG.1
FIG. 1 is a schematic illustration of a well known battery of coke oven chambers and associated machinery used for the pushing and catching of coke from the oven chambers.

In FIG. 1, there is illustrated schematically a plurality of coke oven chambers 10 arranged in a well known spaced apart and side-by-side manner with gas heating flues 11 between adjacent oven chambers for the combustion of gases to carry out the coke making process. In the roof of each oven chamber 10 there is provided a plurality of charging holes 12 for loading coal into each oven chamber from a charging car 14 having hoppers 15 containing the coal charge. The charging car 14 is movable along the oven roof of the battery of coke ovens successively from one oven chamber to another oven chamber. A battery of coke ovens is typically referred to as having a machine side, and at this side of coke ovens there is provided a track 13 in the form of spaced apart parallel rails used to support a pushing machine 16 for movement along the battery of coke oven chambers and into alignment with each of them for pushing selectively the coke therein by employing a ram 17. The ram is carried by the pusher machine 16 and includes a drive apparatus not specifically shown. The pusher machine may also carry a driven leveling bar 18 that is inserted into each coke chamber through a slot near the top of a coke oven door 19 after the charging of coal to level the coal charge for the coking operation. The pushing machine may also carry the necessary tooling for removing the pushing machine side oven doors, cleaning door and door jam and replacing these doors as necessary at the end of the pushing operation.

A battery of coke oven chambers is also typically referred to as having a coke side, where there is usually provided two separate tracks 21 and 22, each consisting of spaced apart parallel rails. A coke guide 23 is carried by a wheeled car along the track 21. A coke transfer hot car 24 is moved along track 22 by a controllable drive apparatus, such as a locomotive 25 incorporting an electric or diesel motor for propelling the car 24 along the track. The coke guide also contains tooling for removing, cleaning, and replacing the coking side oven doors as necessary, similar to the pushing machine tooling.

Figure 2A:
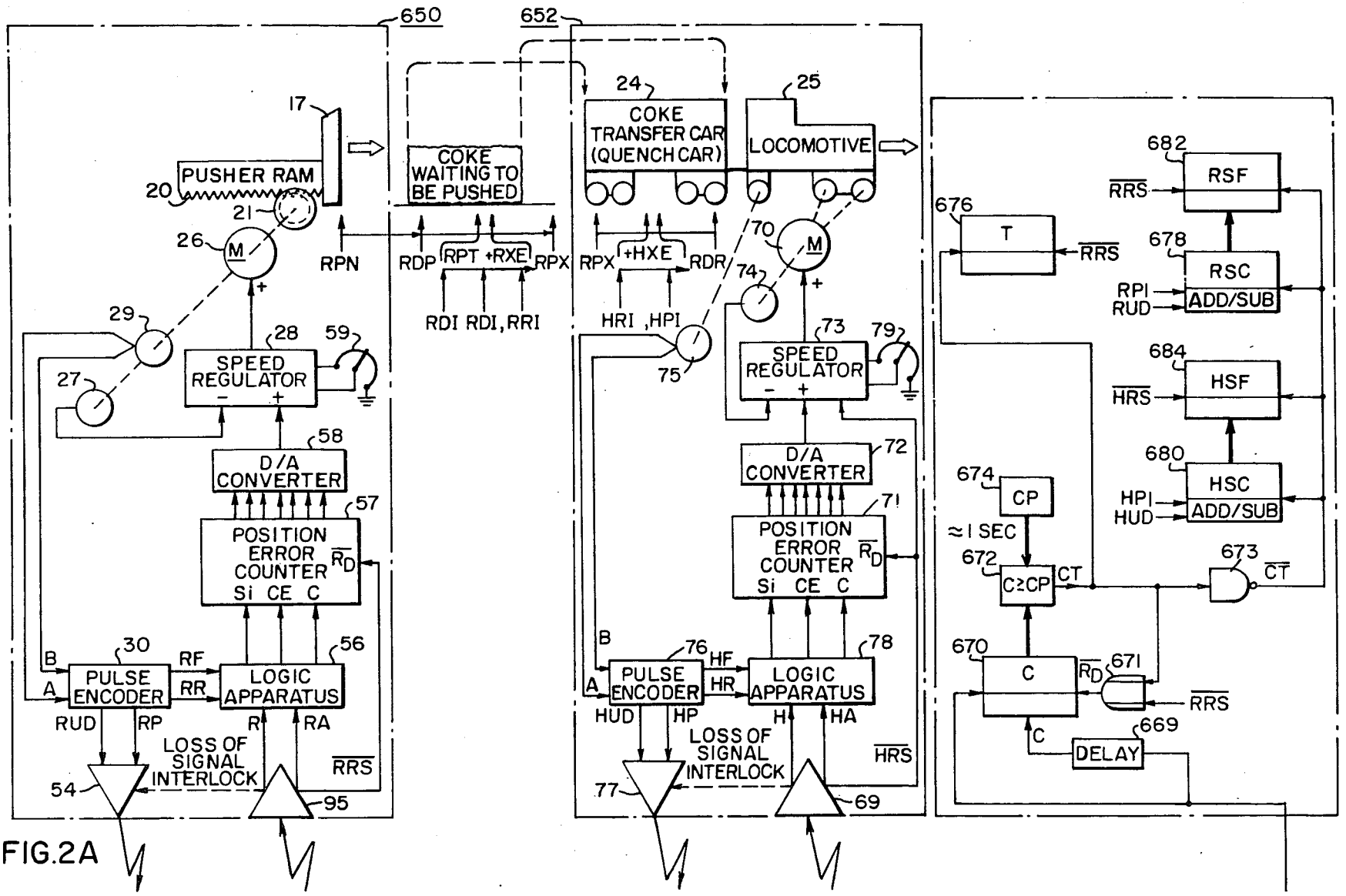
FIG. 2 is a diagrammatic illustration of the control system and method according to the present invention.
Figure 2B:
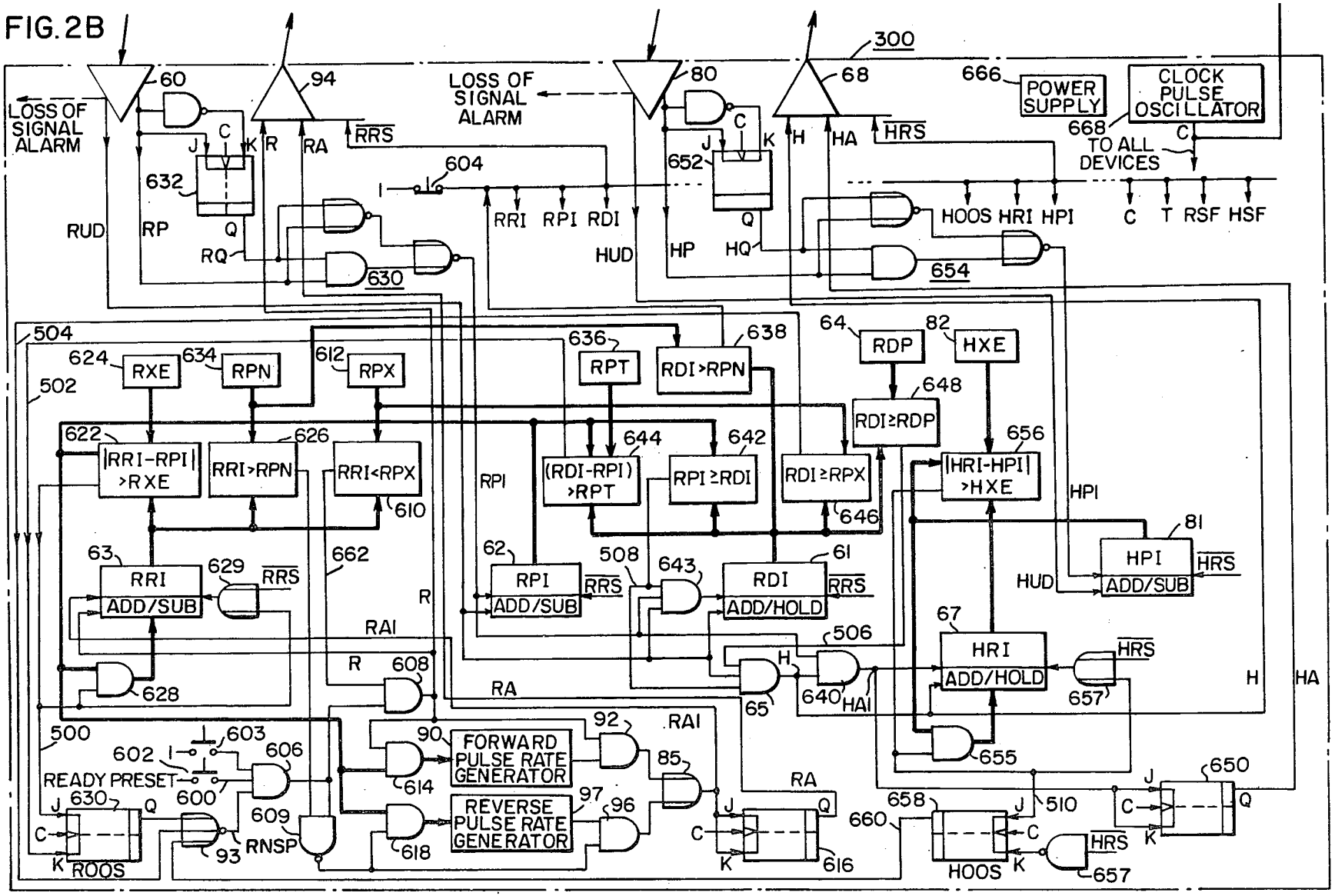

FIG. 2 illustrates the present control system and method used to control and synchronize the forward advancing motion of the pusher ram 17 through a selected one of the coke oven chambers and in relation to this motion the desired traverse movement of the coke transfer hot car 24 at the coke side of that oven chamber.

The hot car has a human operator or related control positioning system who initially positions the hot car adjacent to the given coke oven before or prior to cooperation with the pusher ram that is moving through the same coke oven, and after the discharged coke has filled the hot car, the operator drives the hot car to the quench station. The here described control operation applies for moving the hot car during the actual coke loading and for synchronizing the movement of the hot car with the movement of the ram. The hot car operator cannot physically see the pusher ram, and he can only see the coke leaving the coke guide and filling the hot car. The pusher ram human operator can only see the tail end of the pusher ram going into the selected coke oven.

A logical signal is in binary bit information form either a ONE for true or a ZERO for false, whereas the real signal and the integer signal are represented by Arabic numbers. For example, each count represents a quarter of an inch so the total number of inches would be one-fourth of the total count in the counter 62 or in the counter 81 and the number of feet would be one 1/48 of that number. The signal H uses F (false) or zero for stop and T (true) or one for forward, and the signal R is similar for the ram operation. The central controller 300 functions with clock pulses from a clock oscillator 668, with those clock pulses occurring at some synchronous rate. The example here uses four clock pulses for each 0.25 inch movement of the pusher ram at full speed reverse.

It is assumed, before the pusher ram is controlled as here disclosed, that other related and necessary previous operations have been completed. For example, the initial locating of the hot car in the desired loading position adjacent the coke guide for the selected oven to be emptied is completed, the opening and removal of the doors at the opposite ends of the oven to be emptied is completed and the locating of the pusher ram is completed for subsequent movement through the selected oven to be emptied. In addition the desired cross battery interlocking is provided by operator action communication or the like to be sure that the pusher ram, the coke guide and the hot car are located in relation to the same coke oven, and to establish that the corresponding oven doors have been removed from both sides of the same coke oven, as would be well known to persons skilled in the operation of coke ovens, including the sequence of charging and of pushing a selected coke oven one at a time out of a bank of perhaps eighty ovens as determined by the operator.

The ready preset signal is received at terminal 600 when the controller operator is ready to begin the here controlled pushing of a selected coke oven, and this can be provided by the operator initiating the pushing operation by closing the switch 602. The switch 602 can hold itself closed to continue the provision of the ready preset signal until the operator may desire to stop the pushing operation for some reason at which time the operator would discontinue the ready preset signal by opening the switch 602. At this time it is desired to zero the settings of the various counters operating as position registers, such as counter 63 to indicate the desired position RRI of the pusher ram, counter 62 to indicate the actual position RPI of the pusher ram, counter 61 to indicate the forwardmost position RDI of the pusher ram, counter 57 to control pusher ram speed, counter 67 to indicate the desired position HRI of the hot car, counter 81 to indicate the actual position HPI of the hot car and counter 71 to control hot car speed. In addition, sample hold display 682 indicates the pusher ram speed RSF or rate of movement and sample hold display 684 indicates the hot car speed HSF or rate of movement. The operator can zero the settings of these selected counters, as well as the JK flip-flop 658 for hot car out of step, the elapsed time counter 676 and the clock counter 670, by opening reset before start switch 604. When switch 604 is released a low speed limit is introduced to the hot car speed regulator. If desired, an interlock can be provided to prevent reset of these counters once the pusher ram 17 has begun to move into a given coke oven by comparing the forwardmost position RDI with the reverse limit RPN through comparator 638.

The comparators 622, 626, 610, 638, 644, 642, 646, 648, 656, and 672 are per se well known devices, and operate as understood by persons skilled in this art as a ganged exclusive OR circuit.

When the operator desires to begin the pusher ram movement into a selected coke oven, he closes the GO switch 603. The forward AND gate 606 is thereby set to a ONE state, and the high limit gate 608 is now turned on to provide a ONE signal. The high limit gate 608 receives a ONE signal from the comparator 610 in relation to the desired position RRI of the pusher ram being less than the predetermined forward limit RPX for the pusher ram as set by the operator through thumb wheel 612. This indicates that the pusher ram is not at the maximum forward limit position, so the output signal from comparator 610 is true and a ONE state. The high limit gate 608 provides the signal R in a true or ONE state. The signal R operates with the AND gate 614 to permit the actual position count RPI from the counter 62 to go into the forward pulse rate generator 90. In addition it permits the AND gate 92 at the output of the forward pulse rate generator 90 to start passing pulse signals from the generator 90.

Figure 11:
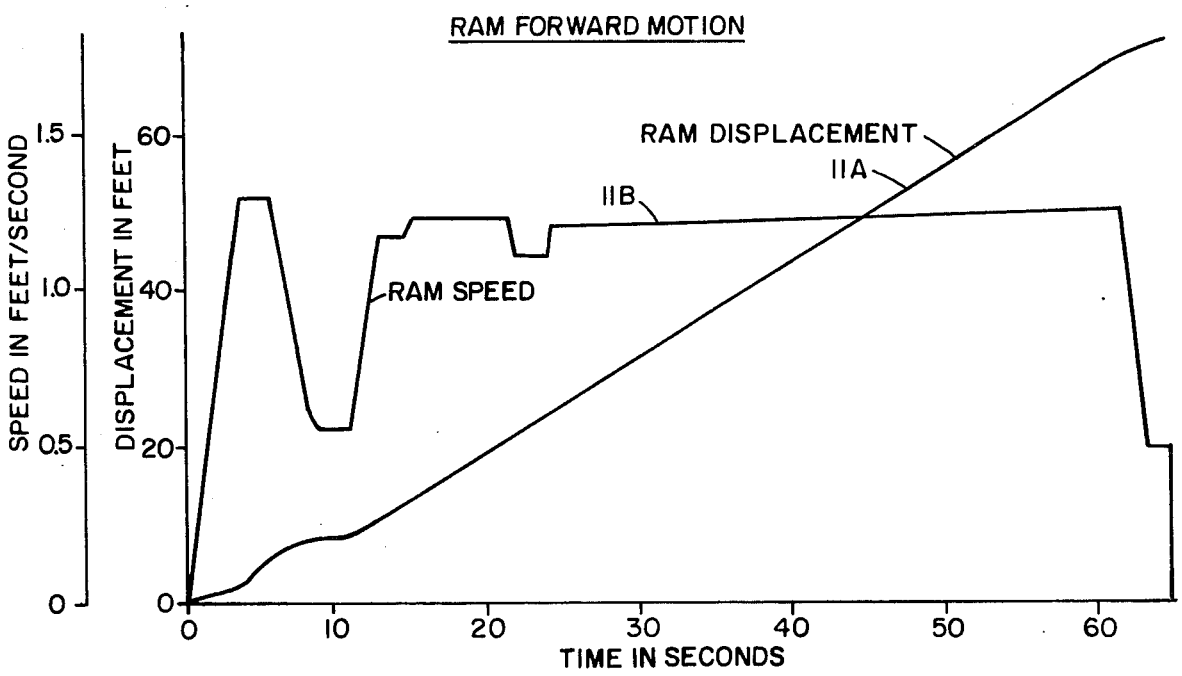
FIG. 11 shows a graph of the desired speed and position relationship in time, of the pusher ram for forward movement thereof.

In FIG. 11 there is shown the curve 11A to illustrate the ram displacement as a function of the desired speed per position relation in time of the pusher ram for forward movement thereof; and this would be in accordance with the signal RPI supplied to the forward pulse rate generator 90. This would be the actual position of the pusher ram as known by the controller 300. The curve 11B illustrates the desired pulse rate and corresponding desired speed from the forward pulse rate generator 90 in relation to the actual displacement of the pusher ram.

Figure 13:
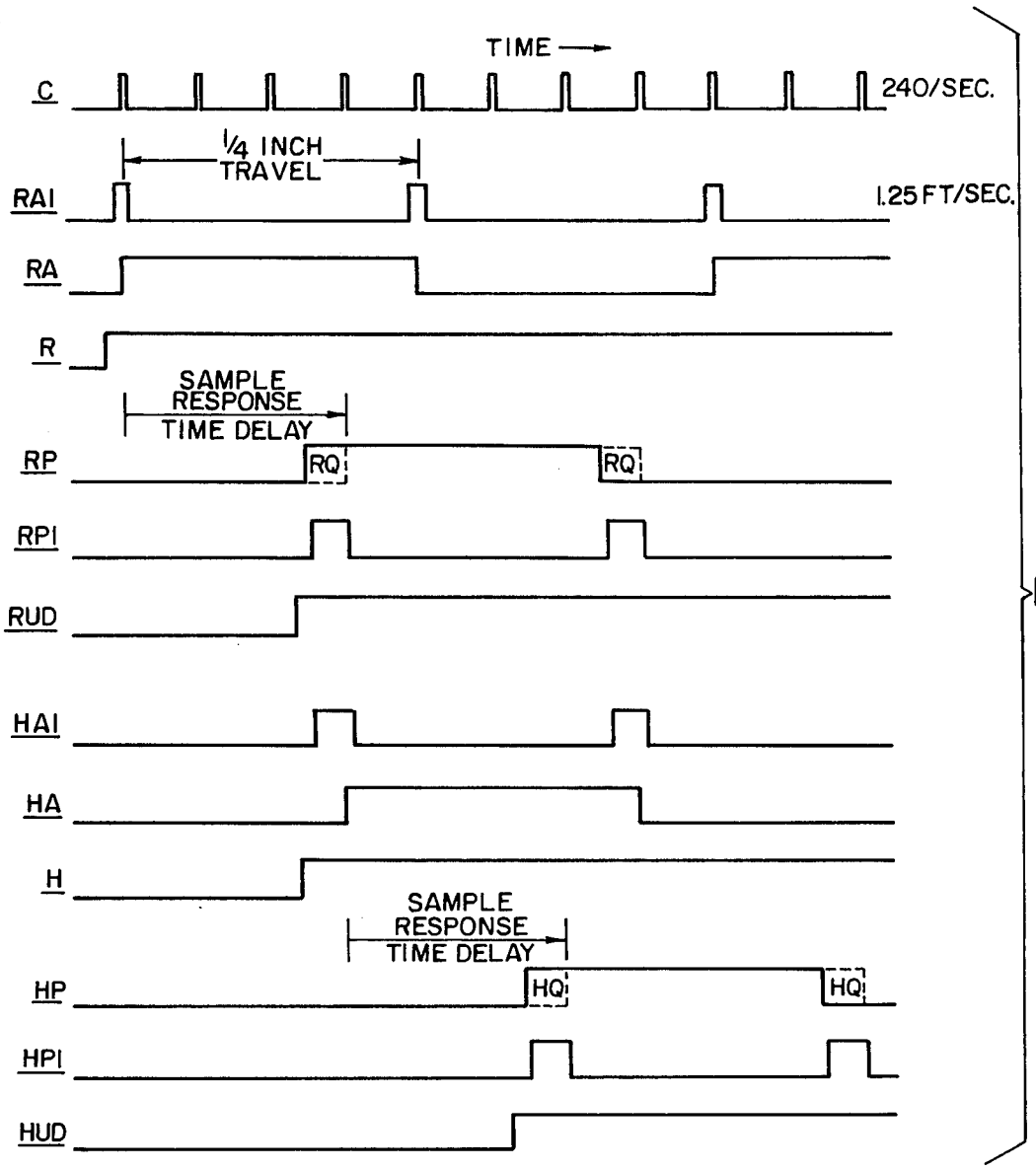
FIG. 13 illustrates in graphic form the sample pulse response for starting the pusher ram at a mid forwardmost position.

In FIG. 13 there is illustrated as a function of time the pulse signal R from the high limit AND gate 608, and the associated signal RA1 from the AND gate 92 and the OR gate 85 provided at the rate of one signal RA1 for each four clock pulses and corresponding to ¼ inch movement of the pusher ram. The signal RA is shown as supplied by the toggle flip-flop 616. Thus for a particular displacement of the pusher ram as shown by curve 11A, the signal RA1 would occur at the illustrated rate in relation to the clock pulses. The signal RA1 is the ram output pulse and the pulse rate is proportional to desired ram speed, and can come out of either one of the forward pulse rate generator 90 or the reverse pulse rate generator 97. If the desired position RRI becomes greater than the forward limit RPX when the pusher ram is moving forward, the AND gate 608 will no longer provide the signal R. If the desired position RRI becomes less than the reverse limit RPN when the pusher ram is moving reverse, the NAND gate 609 will remove an output signal to the AND gate 618 and to AND gate 96 to stop the ram in the retract position.

In relation to FIG. 11, where the pusher ram speed is shown in feet per second, if a speed of 0.5 feet per second is desired to signal RA1 would have a pulse rate corresponding to that many corresponding number of 0.25 inch per second and six inches times 4 is 24 pulses per second. Thusly, the curve 11A shows the input to generator 90 (forward direction) and the curve 11B shows the output pulse rate from generator 90.

Figure 12:
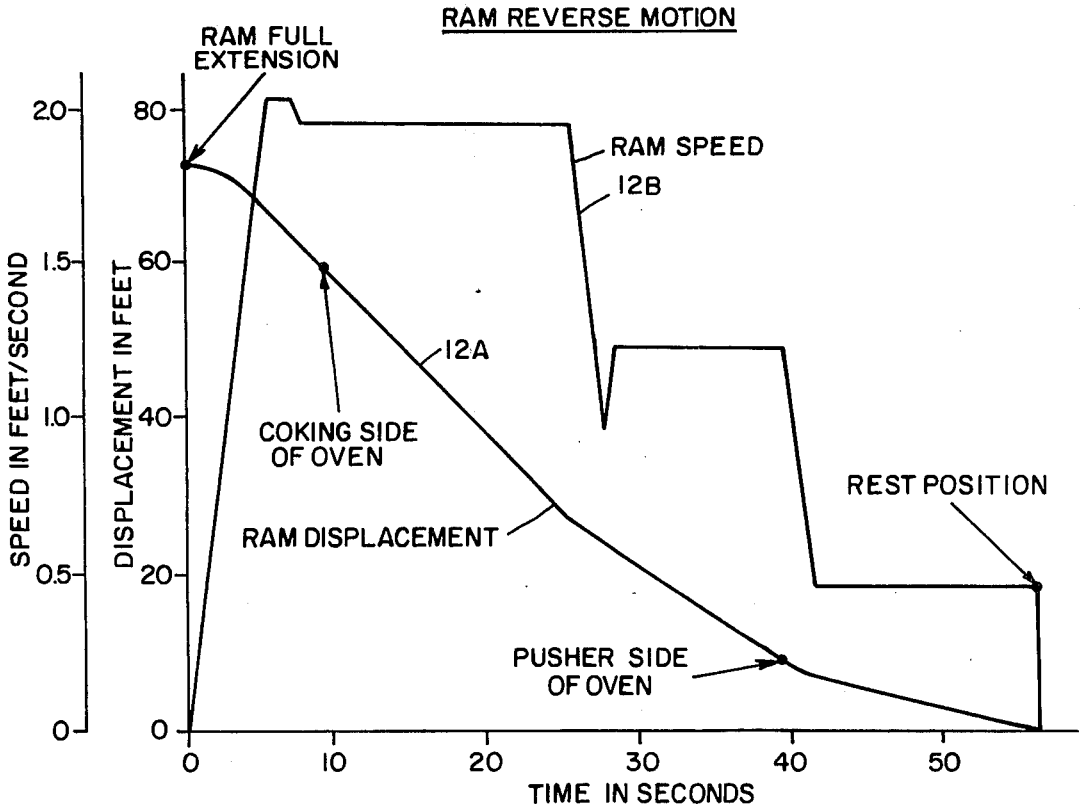
FIG. 12 shows a graph of the desired speed and position relationship in time, of the pusher ram for reverse movement and retraction thereof.

FIG. 12 shows reverse direction, with the curve 12A showing the input to reverse pulse rate generator 97 and the curve 12B showing the output pulse rate from the generator 97. It should be noted that the pusher ram speed going forward in typical operation of a coke oven is at about one-half speed as compared to going backward. The JK flip-flop 616 will change the pulses of signal RA1 into the signal RA having the ON-OFF characteristic as shown in FIG. 13. The signal RA is transmitted to control the pusher ram, and is seen to toggle for every 0.25 inch of desired displacement.

The signals R, RA, and $\overline{\text{RRS}}$ are transmitted to the pusher ram by the signal transmitting amplifier 94 through wires or other conductive media or by wireless communication apparatus and received by the signal condition circuit 95 carried on the pusher ram machine. Signal $\overline{\text{RRS}}$ is the counter 57 reset (zero) signal to begin the pushing operation. Signal R indicates the desired direction (T=forward (one) and F=reverse (zero)). Signal RA toggles once for each ¼ inch desired movement of the pusher ram. Signal R and RA are delivered through the direction logic circuit 56 to the resettable position error counter 57 having its output terminals connected to a digital-to-analog converter 58, described later in more detail in relation to FIGS. 6, 7, 8, 9, and 10.

As illustrated schematically, the pusher ram 17 has rack teeth 20 which are drivingly engaged by a pinion gear 21 that is, in turn, driven by a drive including a motor 26. This motor is mechanically coupled to a tachometer 27 which provides a speed feedback signal for use by a speed regulator 28 to control the operation of the motor 26 and the pushing speed of the ram 17. The motor 26 is also coupled to a pulse generator 29, which produces A and B pulses as illustrated in FIG. 4 in response to each predetermined incremental displacement (for example, ¼inch movement) of the pusher ram 17, but at a phase displaced relationship such as a 90° displacement. The A pulses and the B pulses are received by a pulse encoder 30, which is illustrated in greater detail in FIG. 3.

Figure 3:
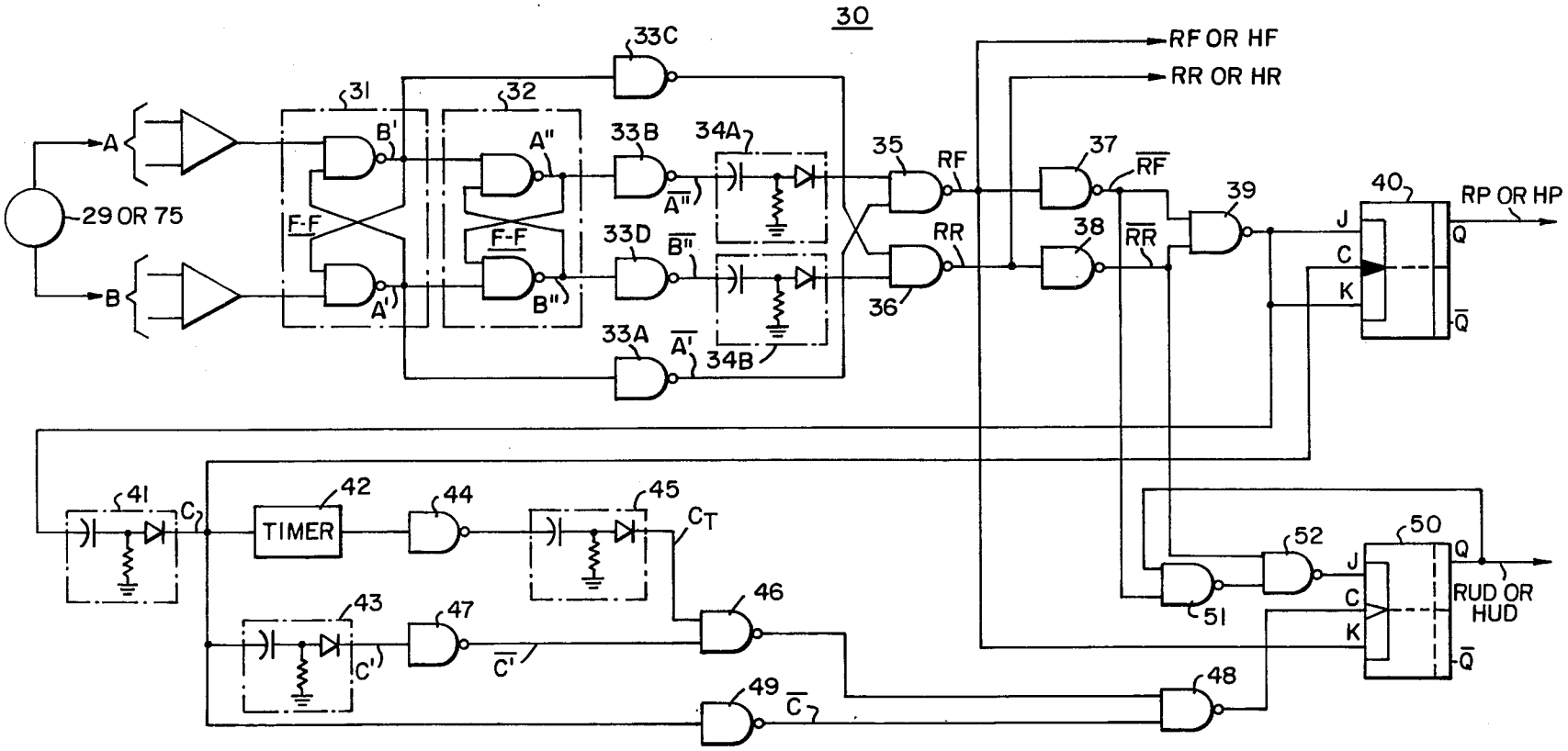
FIG. 3 is a schematic diagram of the pulse encoder apparatus shown in FIG. 2.
Figure 4:
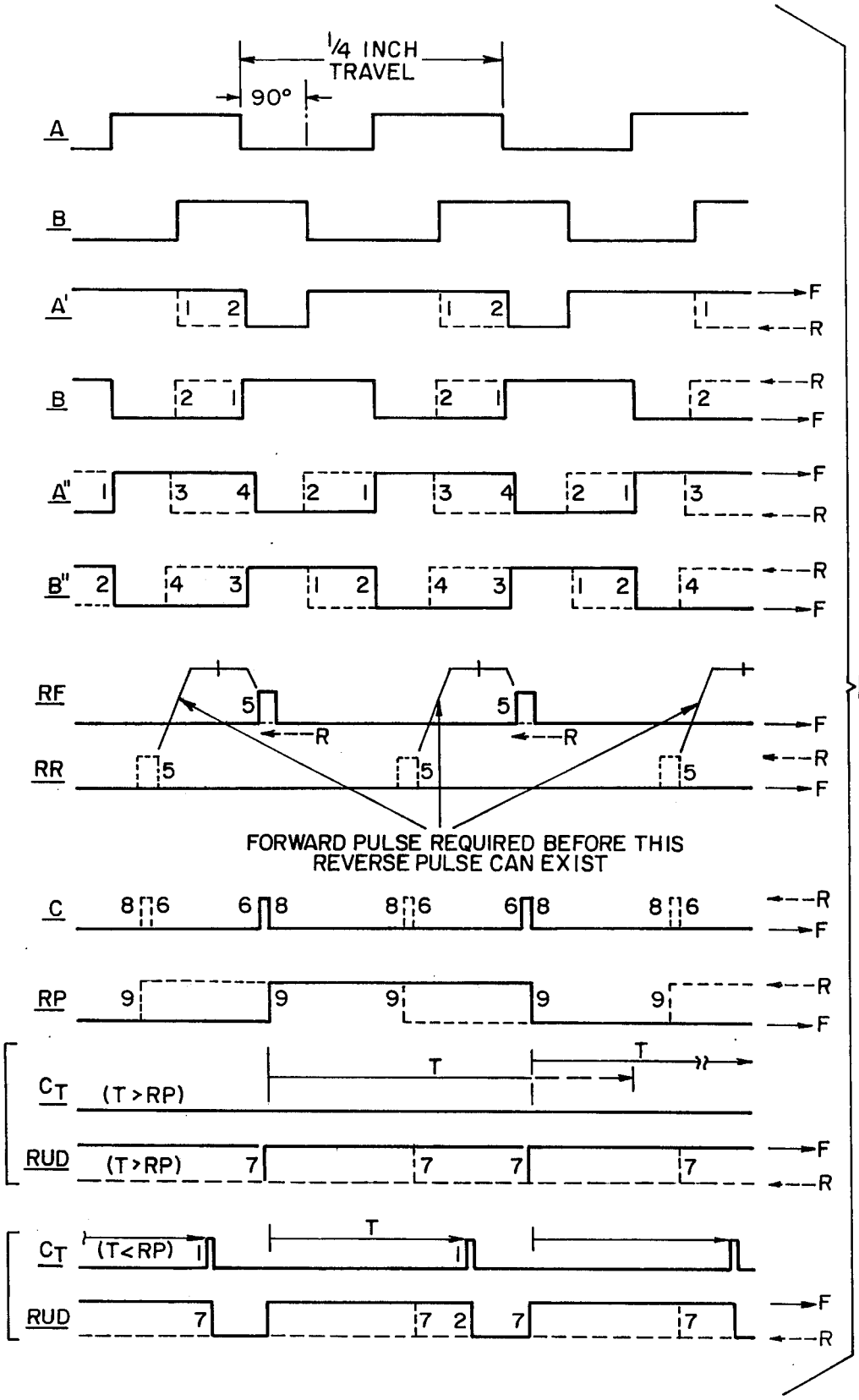
FIG. 4 is a signal waveform chart illustrating the pulse encoder apparatus timing operation.

For describing the operation of the pulse encoder 30 reference is made to FIG. 3, where pulses A and B are taken from the pulse generator 29, and it is desired to obtain transmitted pulses RP and RUD, which are related to pulses A and B by the following Boolean equations, $$RP = (A \cdot B) + (\bar{A} \cdot \bar{B}) \quad \text{, where } \bar{A} = \text{Not A and } \bar{B} = \text{Not B} \tag{1}$$

$$\overline{RP} = (A \cdot \bar{B}) + (\bar{A} \cdot B) = \overline{(A \cdot B) + (\bar{A} \cdot \bar{B})} \text{ , where } \overline{RP} = \text{Not RP} \tag{2}$$

$$RUD = (\dot{A} \cdot \bar{B}) + (\dot{B} \cdot A) + (\dot{\bar{A}} \cdot B) + (\dot{\bar{B}} \cdot \bar{A}) \text{ , where } \dot{A} = \text{Pulse A, } \dot{\bar{A}} = \text{Pulse } \bar{A}, \dot{B} = \text{Pulse B, and } \dot{\bar{B}} = \text{Pulse } \bar{B} \tag{3}$$

$$\overline{RUD} = (\dot{\bar{A}} \cdot \bar{B}) + (\dot{\bar{B}} \cdot A) + (\dot{\bar{A}} \cdot B) + (\dot{\bar{B}} \cdot \bar{A}), \quad \text{where } \overline{RUD} = \text{Not RUD} \tag{4}$$

The pulse RP is to change from pulse RP to pulse $\overline{RP}$ or the pulse $\overline{RP}$ to pulse RP with each incremental displacement. The pulse $\overline{RUD}$ is to change from pulse $\overline{RUD}$ to pulse RUD and hold this setting for a fixed time delay for forward incremental displacement and the reset back to $\overline{RUD}$. Pulse RUD is to change or reset back to pulse $\overline{RUD}$, which is the normal at rest state, without time delay for reverse incremental displacement. The pulse RUD must always change slightly ahead of pulse RP.

FIG. 4 shows a timing chart for functionally describing the pulse encoder 30. Forward displacement shown in solid lines is from left to right, and reverse displacement shown in dash lines is from right to left. Generator pulses A and B are shown at the top of this figure, and pulses RP and RUD are shown towards the bottom of the figure. Two cases are shown for pulse RUD, with the upper being for a reset time delay greater than the rate of change of pulse RLP and with the lower being for a reset time delay less than the rate of change of pulse RP. Other pulses A′, B′, A″, B″, RF, RR, C, and $C_T$ are intermediate results of A and B and are more completely described in relation to the following discussion of the pulse encoder shown in FIG. 3.

As illustrated in FIG. 3, the pulse A and the pulse B from the pulse generator 29 are separately amplified and delivered to tandemly arranged RS flip-flops 31 and 32 which are used to eliminate backlash or dither in the pulse generator 29 while operating at low speed or at a stop condition, particularly when a stop position of the ram is near a pulse producing position of the generator 29. The two outputs from the flip-flop 31 are pulses B′ and A′ which are connected to the flip-flop 32 for producing at its output A″ and B″ pulses, that are related by the respective pulses occurring in a phase opposition relationship. The pulses A′, A″, B′ and B″ are connected to separate NOT inverter circuits 33A, 33B, 33C, and 33D, respectively. The inverted pulses $\overline{A''}$ and $\overline{B''}$ are then connected to separate long single-shot circuits 34A and 34B from which the pulses are fed to separate NAND circuits 35 and 36. The NAND circuit 35 receives the pulses $\overline{A'}$ and $\overline{A''}$ which, upon coincidence of both of these pulses, produces an output pulse RF that is fed to an inverter circuit 37 having its output $\overline{RF}$ connected to a NAND circuit 39. The NAND circuit 36 receives pulses $\overline{B'}$ and $\overline{B''}$ which upon coincidence of these pulses delivers an output pulse RR to an inverter circuit 38 having its output $\overline{RR}$ connected to the NAND circuit 39. The RF pulse becomes a string of short pulses which are produced by forward incremental motion only, as shown in FIG. 4, and the RR pulse becomes a string of short pulses which are produced by reverse incremental motion only, as shown in FIG. 4. The coincidence of the inverted RF pulse $\overline{RF}$ and the inverted RR pulse $\overline{RR}$ produces an output from the NAND circuit 39 which is delivered to a JK flip-flop with negative clock 40 to produce a pulse RP representing incremental motion of the ram in either the forward direction toward the coke quenching hot car or in the reverse direction away from the coke quenching hot car.

Figure 5:
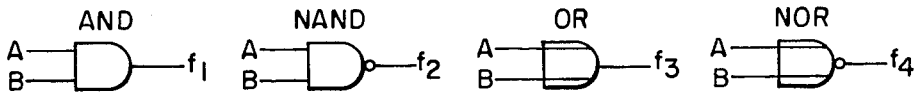
FIG. 5 PRIOR ART
FIG. 5 illustrates the logical operation of well known AND, NAND, OR, NOR, EOR, and COINCIDENCE gates, and type RS and JK flip-flop circuits employed in the apparatus of FIGS. 2, 3, 6, 8 and 9.
Figure 5:
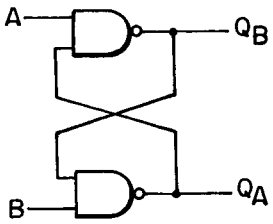
FIG. 5 PRIOR ART
Figure 5:
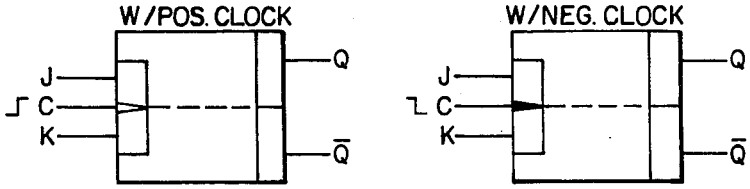
FIG. 5 PRIOR ART

FIG. 5 illustrates the well known Boolean relationships of the logical operations of the respective indicated elements of the encoder circuit shown in FIG. 3, which elements are each well known to persons skilled in this art.

The pulse output from the NAND circuit 39 shown in FIG. 3 is also delivered to a short single-shot circuit 41 providing the output clocking pulse C, which clocks the JK flip-flop with negative clock 40, and which triggers a timer 42, and energizes a long single-shot circuit 43. The timer 42, the inverter 44 and the short single-shot 45 performs the function of delivering a delayed clock pulse $C_T$ for the JK flip-flop with positive clock 50. This insures a clock pulse to turn the pulse RUD off with a time delay after the pulse generator 29 comes to rest. Long single-shot 43 and inverters 47 and 49 blank out leading $C_T$ pulses to prevent premature turn off of the pulse RUD. NAND circuit 48 combines the above into a composite clock pulse C for the JK flip-flop 50. The K input to this flip-flop 50 is the output pulse RF from the NAND circuit 35, and the J input to the flip-flop 50 is produced by inverted RF and RR pulses and a feedback pulse Q from the flip-flop 50. The pulse Q and inverted pulses $\overline{RF}$ are fed to a NAND circuit 51 which has its output connected to a NAND circuit 52, which also receives the inverted pulses $\overline{RR}$ from inverter circuit 38. The output from the NAND 52 forms the J input to the flip-flop 50. The pulse Q output from the flip-flop 50 forms the pulse RUD that represents the forward and reverse motions of the ram denoted in FIG. 2 and in FIG. 3 as the pulses RUD. The pulse Q output from the JK flip-flop 40, forms the pulses RP as indicated previously, and are pulses responsive to any movement, forward or reverse, of the ram and are denoted in FIG. 2 and in FIG. 3 as pulses RP. The pulses RF and RR from NAND 35 and NAND 36 respectively are also used externally from the encoder to decrement the local position error counter 57 shown in FIG. 2, and are denoted as signals RF and RR respectively.

In reference again to FIG. 2, the pulse outputs from encoder 30 are fed to a well known transmission amplifier 54 wherein they are processed and modulated onto carrier signals for transmission by means of either a wireless mode of transmission or through cables or other suitable conducting media to the central controller 300. The pulses RF and RR are fed to a logic circuit 56, described in more detail in relation to FIGS. 6 and 8, which is connected to a resettable position error counter 57 connected, in turn, to a digital-to-analog converter 58, described in more detail in relation to FIG. 9. The output from the converter 58 is a speed reference signal, proportional to the position error for use by the speed regulator 28 in a Type-1speed regulating mode, which Type-1speed regulating system is a well known control system operating to produce a zero steady-state speed error in relation to the speed reference for the driven apparatus.

A potentiometer 59 having a movable slide wire provides gain control to attenuate the position error signal delivered by the digital-to-analog converter 58 to the speed regulator 28.

The amplifier 54, as described previously, produces a modulated signal made up of pulses RP and RUD. This signal is received at the central controller 300 by a signal conditioning circuit 60 where additional amplification may be provided as well as detection and filtering of the received signal. The signals RUD and HUD indicate the position movement direction for the pusher ram and hot car respectively. If the signal RUD is true, this indicates the pusher ram is moving forward and if the signal RUD is false the pusher ram is moving in reverse. Also, the false signal condition can indicate the at rest state, so if the pusher ram stops its movement, the signal RUD will go false, and the same applies to the signal HUD for the hot car. The rate of movement of the pusher ram and the hot car is indicated by the signals RP and HP respectively, and if RP and HP are not changing this indicates the respective pusher ram and hot car are stationary. For every change in one of these signals, the associated ram or hot car has moved in the order of 0.25 inch, depending on gearing. If the signal RUD is false and the signal RP is changing, this indicates the ram is moving in a reverse direction. When the signal RUD is true and the signal RP is changing, this indicates the ram is moving in a forward direction. When the ram moves backwards, the hot car stops and does not back up correspondingly.

The signal RA out of JK flip-flop 616 is at a desired rate of movement for the pusher ram 17. The signal R indicates the desired direction for the pusher ram to move. The signal R becomes set when pulsing signals through the forward generator 90, and not set when pulsing signals through the reverse generator 97. The signals RA1 and R also go to the desired position counter 63, (RRI) which algebraically sums the generated pulses RA1, adding counts when R is true (one), and subtracting counts when R is false (zero). The comparator 610 senses that the desired position RRI has not become greater than the maximum foward limit RPX, and permits the AND gate 608 to supply the signal R and the associated generation of the signals RA1 and RA until the desired position RRI does become equal to or greater than the maximum limit RPX. When RRI becomes equal to or greater than RPX, the signal R is shut off and the signals RA1 and RA are also shut off at this same time. The pulse chart shown in FIG. 13 would be illustrative of the provided pulse signals in relation to the RDP position of the pusher ram 17 as shown in FIG. 2, which would be a middle position moving in the forward direction and shows how the pulse signals are provided throughout the control system operation. If the pusher ram 17 is in position prior to contacting with the coke, and has not yet moved the coke enough to require associated forward movement of the hot car, there is no need for the signals to go on to begin movement of the hot car 24. The signal chart of FIG. 13 illustrates the signals provided when the pusher ram is pushing coke into the hot car, to move the hot car in response to movement of the pusher ram, and this occurs when the pusher ram has reached a position such as RDP.

The signal R is provided to move the pusher ram forward. The JK flip-flop 616 derives the signal RA from the signal RA1, when the clock pulse occurs to synchronize and coordinate the coke pushing and catching operation and to avoid race conditions in the control system operation. The position controller 650 operative with the pusher ram 17 and the positon controller 652 operative with the hot car 24 are each implemented as asynchronous controllers, such that the change of state in the movement control pulse operates to generate the clock pulse. This makes sure all associated signals are set at proper levels because the clock pulse includes a small time delay to occur at proper time desired for switching. The central controller 300 is implemented as a synchronous controller, such that switching occurs at a synchronous rate in relation to a constantly occurring clock pulse, which is provided at the rate of four clock pulses for each 0.25 inch movement at the established maximum forward speed, as illustrated in FIG. 11, of about 1.25 feet per second. This permits cutting down the sample response time delay to some 25% of the 0.25 inch movement. In 1.25 feet of travel there are 15 inches, and in 15 inches there are 60 of the 0.25 inch units, so the clock rate C would be 4 times 60 or 240 pulses per second internally to the central controller.

In parallel with the signals R and RA going to the position controller 650 for the pusher ram 17, the signals RA1 and R go to the desired position counter 63, which is an add or subtract counter, when this counter receives a clock pulse and sees signal RA1 as positive, it will increment. In FIG. 13, a first clock pulse occurs while the signal RA1 is positive and three more clock pulses occur when the signal RA1 is not positive, so the counter 63 increments only for that first clock pulse and when the signal RA1 is true. The R pulse is the sign input to the counter for determining incrementing direction and the CE input is the count enable. The signal RD is reset the display, and it is derived from the inverse of signal RRS. The reset signal can be provided when the desired position RRI is too far ahead or behind the actual position RPI, as established in comparator 622 where the absolute value of RRI minus RPI is compared to determine if it is greater than the maximum position error RXE. The maximum position error RXE is supplied by the operator through a thumbwheel switch 624. This is the largest permitted difference error between the desired position RRI and the actual position RPI of the pusher ram 17, and a typical value here could be one foot. The width of an actual coke oven is about two feet, so the position of the hot car 24 should cover the whole of the open end of the coke oven and the position RDR is shown at a location somewhat away from the end of the hot car 24. This one foot position error maximum limit will properly determine the hot car 24 to receive the pushed out coke from the coke oven. The reverse limit RPN can equal zero and the forward limit RPX is much greater than reverse limit RPN and can be in the order of 50 feet in relation to a typical coke oven.

The ram desired position RRI is supplied to the three logical comparators 622, 626 and 610 in relation respectively to the maximum allowed position error RXE, the reverse position limit RPN and the forward position limit RPX. If the maximum position error signal RXE is exceeded, and this would occur if the signal RPI is lost since the signal RRI would continue to be incremented without receiving back pulses of the signal RPI. The signal RPI is the actual ram position. The output signal 500 from comparator 622 indicates that the ram actual position RPI is beyond the desired position RRI by an amount greater than the maximum position error RXE, and the signal 500 goes into the AND gate 628 to set the counter 63 equal to the counter 62, and this removes the signal 500. The signal 500 also goes into the ram out of step JK flip-flop 630, which is operative as a set and reset flip-flop. On the set, the signal 500 when provided to flip-flop 630 switches the signal Q, to true which changes the state of NOR gate 93 to turn off the forward AND gate 606, and this results in the reverse pulse rate generator 97 providing pulses to reverse the direction of the pusher ram 17. The signal R changes to cause the ram to change direction, and the pulse rate is provided in accordance with the illustration of FIG. 12, through AND gate 96 and OR gate 85 to create signal RA1 to decrement counter 63. The JK flip-flop 616 provides the signal RA to cause the ram 17 to reverse.

The operation of the pusher ram 17 and the position controller 650 have been previously described. The signal RUD and RP coming back to controller 300 are shown in FIG. 13. The signal RUD indicates direction, with ONE indicating forward and ZERO indicating reverse. The RP signal gives a change pulse everytime the pusher ram 17 moves 0.25 inch, and it changes from a ONE signal to ZERO signal as shown in FIG. 13. To decode the signal RP, the exclusive OR 630 and JK flip-flop 632 are provided. When the signal RP changes, the signal RQ is the old value until the clock pulse occurs when the signal RQ becomes the same as the signal RP, so the signal RP1 goes away. This provides the signal RP1 in the form of a pulse suitable for driving counters and the like within the central controller 300. The signal RA1 was generated from signal RA, and now similarly the signal RP1 is generated from signal RP, with the JK flip-flop 632 and exclusive OR 630 operating as the inverse of the JK flip-flop 616. The signals RP1 and RUD are fed into the counter 62 to indicate the actual position of the pusher ram 17. The RPI counter 62 is an add/subtract counter. And in parallel, the signal RUD also is fed to AND gate 65 to indicate the ram 17 is moving forward and the signal RP1 goes into AND gate 640. When the signal RPI is greater than or equal to the signal RDI, as determined by comparator 642 providing signal 508, this indicates that the pusher ram 17 is presently at its forwardmost position. This enables counter 61 to be incremented when signal 508, RUD, and RP1 are all true at AND gate 643. The latter counter is an add/hold counter in operation, which means that when the pusher ram 17 moving forward, the count is increased by addition, and when the pusher ram 17 is moving in reverse, the count is not reduced by subtraction.

If the situation occurs that pulses are lost, this will result in a failure of counter 62 to follow properly the count of counter 63. Comparator 644 indicates that the difference (RDI minus RPI) would be greater than the retract limit RPT, when the pusher ram 17 reverses. The signal RDI would stay constant and the signal RPI starts to decrease. When the difference of RDI minus RPI becomes greater than the retract limit RPT, the signal 502 is supplied by comparator 644. The signal 502 turns off the flip-flop 630, and the output of NOR 93 then goes to a ONE state and the pusher ram 17 would begin to move forward again assuming the operator has his finger holding closed the GO button 603. If operator removes GO signal, if ram out step signal 502 is provided or if hot car gets out of step, the pusher ram 17 will begin to reverse in direction and will retract all of the way out of the coke oven. The retract limit comparison signal 502 only has an effect when the signal RPI is out of step with the signal RRI, for example upon loss of signal or if coke sticks and no ram displacement occurs since the coke is not being pushed out of oven. When a coke sticking condition occurs, it is desired to back up the ram and then jam it forward again to hit the stuck coke in the coke oven. At any time the operator no longer wants the ram to repeatedly jam against the stuck coke in the oven, the operator can discontinue closing the GO switch 603 and the pusher ram 17 will retract out of the oven. When the ram is beyond the maximum position error RXE as determined by comparator 622, this starts the ram 17 to reverse and when the retract limit RPT has been reached the ram 17 will again move forward. The retract limit RPT can be selected as one, two or three feet as required for the ram momentum to hit the stuck coke to break it loose as desired by the operator. The operator at the pusher ram side of the oven has control of the GO switch 603 and can determine the latter operation as he desires. The retract limit is set by thumb wheel switch 636.

The forwardmost position counter 61 is logically kept at the forwardmost position of the pusher ram 17. The actual position counter 62 is kept at the actual position of the pusher ram 17. When the actual position RPI is equal to or greater than the forwardmost position RDI, the comparator 642 provides the output signal 508.

When the ram has reached the extreme position of forward travel such that signal RDI become greater than or equal to signal RPX as determined by comparator 646, the output signal 504 is provided to turn off the NAND gate 93 and switch the forward AND gate 606 causing the pusher ram 17 to reverse and retract is position. Before starting the next push of another coke oven, the forwardmost position counter 61 would be reset by the reset button 604.

Signals are sent to control the position of the hot car 24 when the signal RDI is greater than or equal to the signal RDP as determined by comparator 648 and the signal 506 is provided. The signal RDP is established by the operator with the thumbwheel 64 in accordance with the ram position where the coke leaving the oven is about to start falling into the hot car 24. The signal 506 is combined with the forwardmost position signal 508 from comparator 642 and with the signal RUD indicating the pusher ram is moving in a forward direction as sensed by the AND gate 65, to set up the direction pulse H in a true or ONE state for the hot car to move forward. Additionally, the signal H is combined with the signal RP1 in AND gate 640 for generating the signal HA1, which then increments the desired position counter 67 in accordance with the desired position of the hot car 24. In parallel with the latter operation, the signal HA1 also goes to the JK flip-flop 650 for generating the signal HA, in a manner similar to operation of JK flip-flop 616 for generating signal RA in relation to signal RA1.

The signals H, HA and $\overline{HRS}$ are transmitted to the hot car by the signal transmitting amplifier 68 through wires or other conductive media or by wireless communication apparatus and received by the signal condition circuit 69 carried on the hot car motor driven locomotive 25. Signal $\overline{HRS}$ is the counter 71 reset (zero) signal to begin the pushing operation. After resetting the counter signal $\overline{HRS}$ set (one) applies a low speed limit signal of say 2.5 ft./sec. to the locomotive speed regulator. This is the maximum speed rating of the pusher ram. The locomotive has normally a high speed rating for racing to the coke quenching station, then to a coking wharf where unloading takes place, then back to the next scheduled oven to be pushed. This change in speed limit can be coupled with selection of a low speed gear ratio for a stable speed gain. The hot car operator likewise has facilities to remove this low limit and change gear ratios for traversing the hot car to its other stations.

Signal H indicates the desired direction (T=forward (one) and F=reverse (zero)). Signal HA toggles once for each ¼inch desired movement of the hot car. Signals H and HA are delivered through the direction logic circuit 78 to the resettable position error counter 71 having its output terminals connected to a digital-to-analog converter 72, described as follows in more detail in relation to FIGS. 6, 7, 8, 9, and 10.

Figure 6:
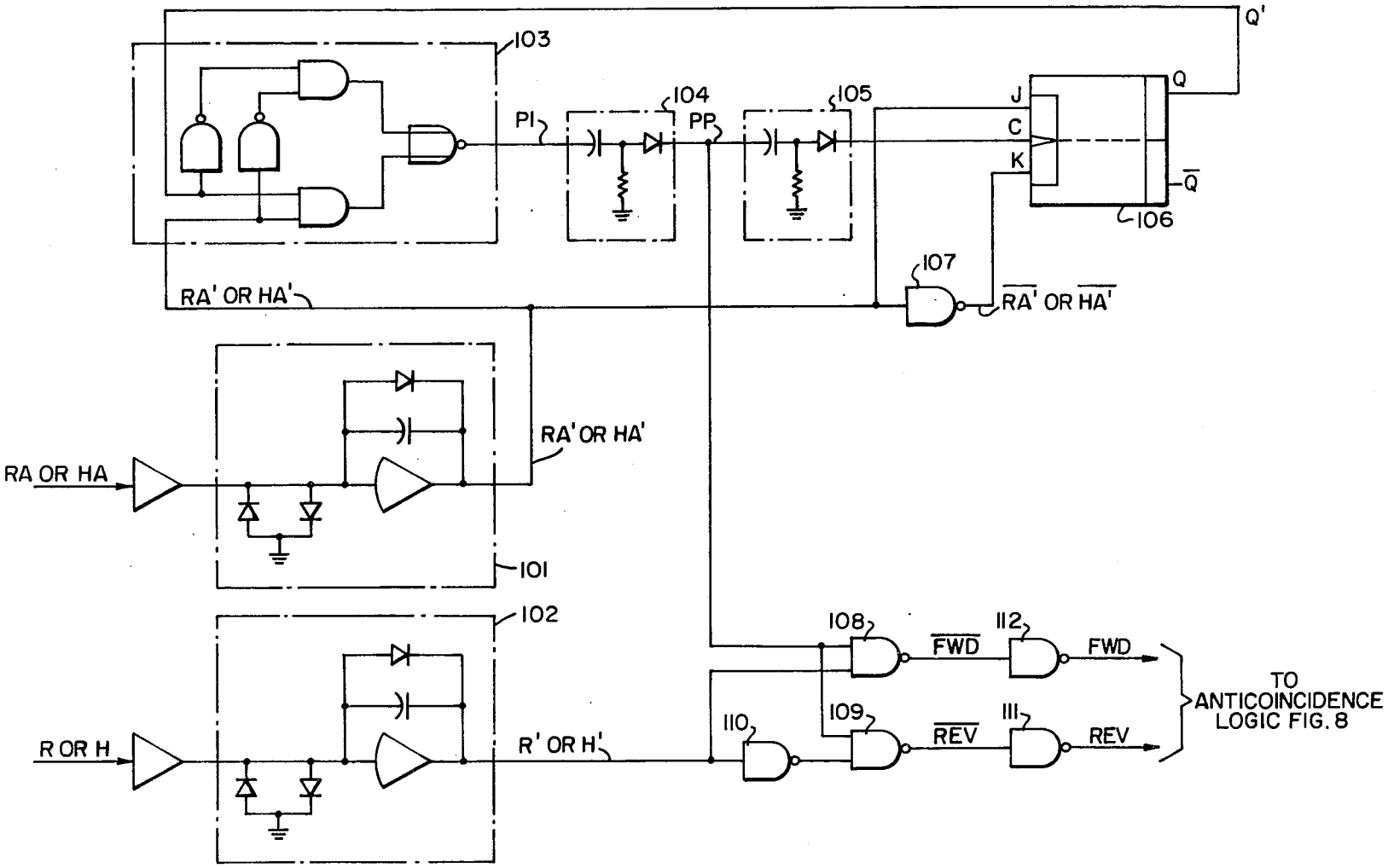
FIG. 6 is a schematic showing of the pulse decoder and signal conditioner apparatus utilized in the logic apparatus of FIG. 2.

In the operation of the pulse decoder shown in FIG. 6 and in relation to the logic apparatus 56 or 78, signal pulses R and RA or H and HA are received from signal conditioner 95 or 69 respectively. The functional description of the hot car control signal operation will now be provided, with the understanding that a generally similar operation occurs in relation to signals R and RA, RF and RR for controlling the pusher ram. Signals H and HA are passed through line driver and filter integrating amplifier 101 and 102 respectively for providing pulses HA′ and H′. To monitor the desired incremental displacement which the coke transfer car 24 is to follow, it is necessary to detect each logical reversal in pulse HA′. This is done through the exclusive OR circuit 103 by the Boolean equation $$P1 = \overline{(\overline{HA'}\cdot\overline{Q'} + HA'\cdot Q')} \qquad \text{(See FIG. 5) (5)}$$

where Q′ is equal to the last state of HA′ and P1 becomes active whenever HA′ is not equal to Q′ (i.e., whenever a change in HA′ occurs). Pulse P1 could also be provided using a coincidence circuit and the pulses HA′, $\overline{Q'}$ provided by the Boolean equation $$P1 = \overline{(\overline{HA'\cdot\overline{Q'}} + \overline{\overline{HA'}\cdot Q'})}\ (\overline{\overline{Q'}} = Q') \qquad (6)$$

or P′, Q′

$$P1 = \overline{(\overline{\overline{HA'}\cdot Q'} + \overline{HA'\cdot\overline{Q'}})}\ (\overline{\overline{HA'}} = HA') \qquad (7)$$

which are equivalent via term reversal. The long single-shot 104 produces a more uniform pulse PP when the pulse P1 turns on (or goes to a one state). The pulse PP is more suitable in width for driving other circuits. A clock pulse C is derived from the short single-shot 105, when pulse PP is turned on. This clock pulse triggers the memory type JK flip-flop with positive gate 106, causing it to take on the present state of the pulse HA′. This occurs since the pulses HA′ and $\overline{HA'}$ through operation of NOT circuit 107 are connected to inputs J and K respectively. The pulse Q′ is provided from the positive output Q of flip-flop 106, and turns the exclusive OR circuit 103 off. When the next change in the pulse HA′ occurs, the above sequence repeats itself and flip-flop 106 acquires the new state of the pulse HA′. In parallel with the connection of pulse PP above described, this pulse is also connected to the steering NAND circuits 108 and 109, which are also supplied with the signal H′ and the signal $\overline{H'}$ as shown provided by the NOT circuit 110. When the pulse H′ is turned off the pulse PP passes through NAND 109, and results in the provision of pulse $\overline{REV}$ and pulse REV through operation of NOT circuit 111, while the pulses $\overline{FWD}$ and FWD do not occur at this time. When the pulse H′ is turned on the pulse PP passes through NAND 108, and results in the pulses $\overline{FWD}$ and FWD through operation of NOT circuit 112, while the pulses $\overline{REV}$ and REV do not occur at this time. This circuit shown in FIG. 6 operates to decode and provide the required direction pulses FWD (forward) and REV (reverse) for accelerating the associated locomotive 25 in the desired direction.

Figure 7:
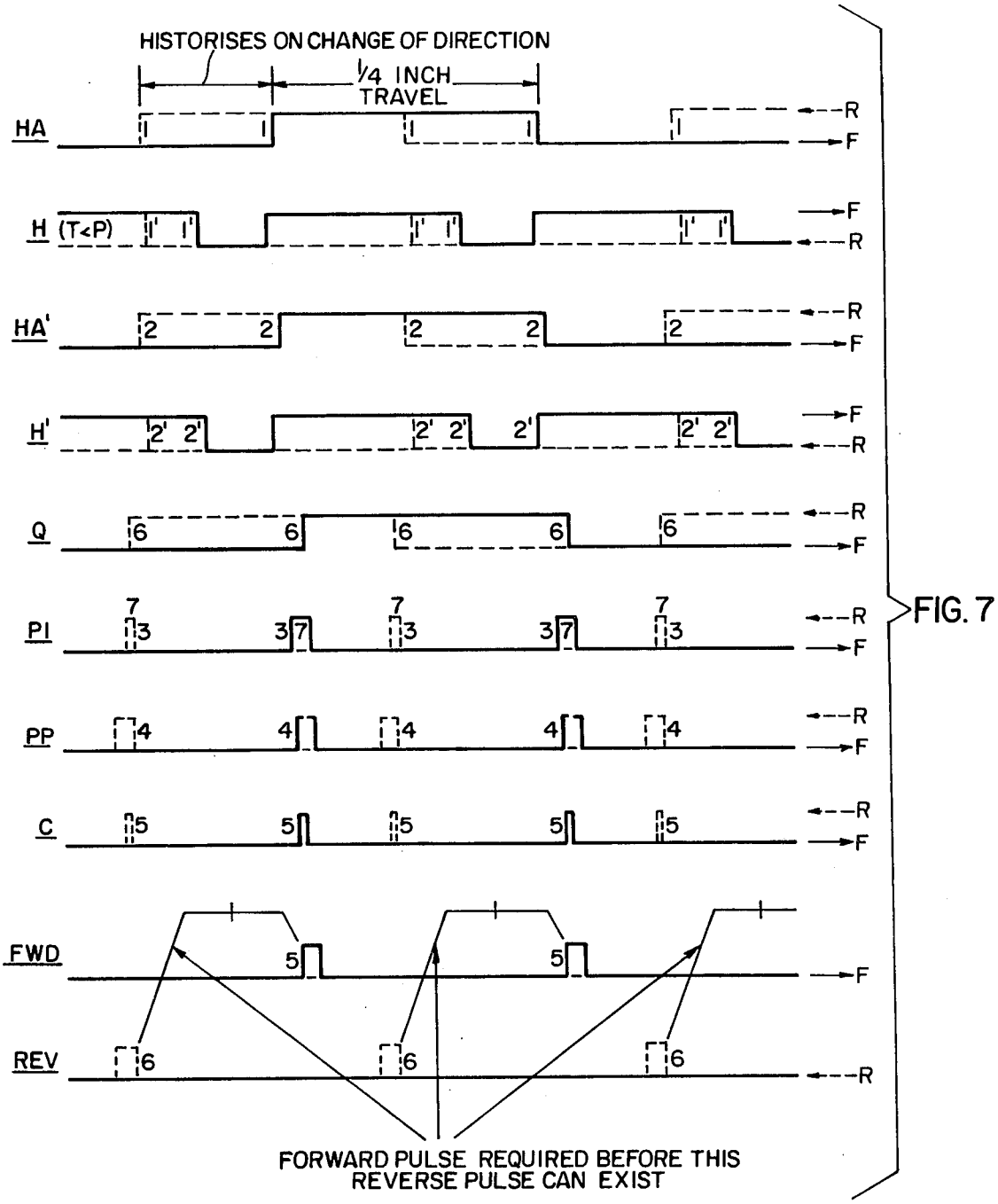
FIG. 7 is a signal chart illustrating the operation of the pulse decoder.

A timing chart for this pulse decoder circuit is shown in FIG. 7, which illustrates the desired FWD-REV pulses interlocking to prevent hunting or miscounting errors in the drive system. The H pulse is shown in FIG. 7 while the ram is moving at a very slow rate of speed to illustrate the worst case for the pulse H. A high rate of speed would be the worst case for the HA pulses. It should be noted that the maximum drive speed for pushing, and gear reductions for the pulse generators 29 and 75 must be selected to avoid overdriving the HA pulse circuitry rates.

Figure 8:
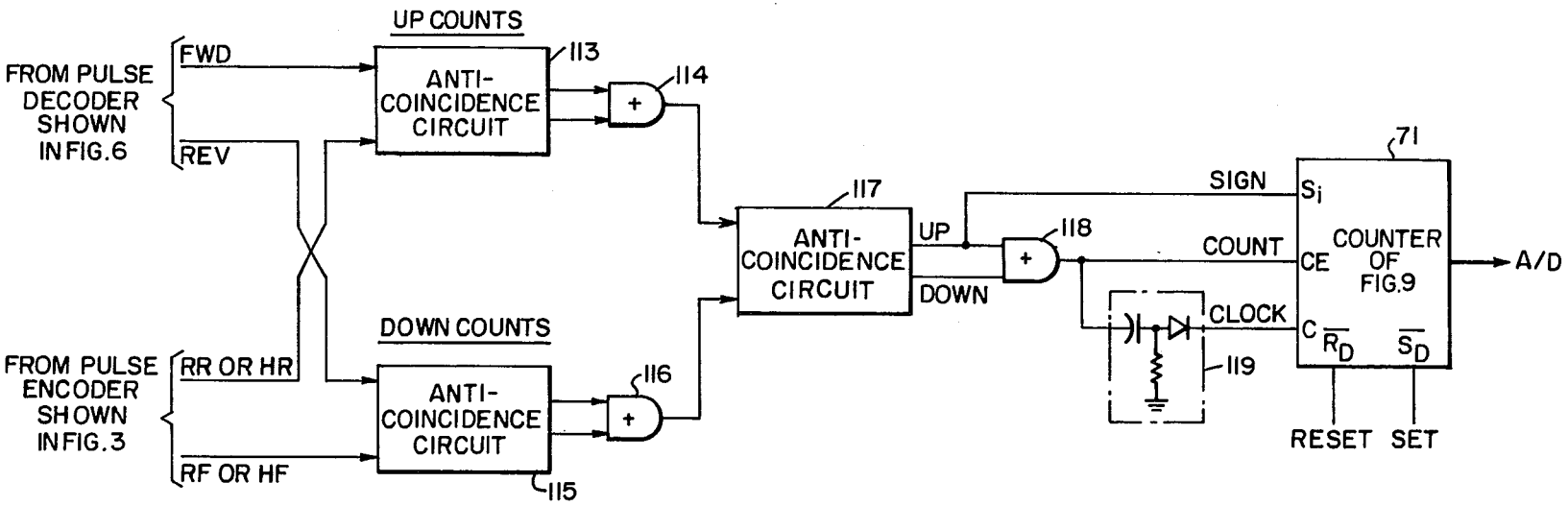
FIG. 8 is a schematic illustration of the forward-/reverse anticoincidence logic circuit utilized in the logic apparatus of FIG. 2.

FIG. 8 illustrates a block diagram of suitable anticoincidence circuitry required to, accurately separate and not lose count of, accelerating pulses FWD or REV provided by the pulse decoder shown in FIG. 6 and the decelerating pulses RF and RR, or HF and HR provided by the respective pusher ram or hot car pulse encoder shown in FIG. 3. The pulse encoder 76 is similar in operation to encoder 30 described earlier in relation to FIG. 3. The FWD and HR pulses are connected to the anticoincidence circuit 113, and cause the drive to accelerate or decelerate respectively towards the forward direction (UP COUNTS). Should these pulses occur simultaneously, this circuit 113 separates and steps each one through an alternate or first come first serve basis to the OR gate 114. This same sequence takes place for the REV and HF pulses in the anticoincidence circuit 115, which causes the drive to accelerate or decelerate respectively towards the reverse direction (DOWN COUNTS). These pulses are alternately gated to the OR gate 116. The outputs of OR gates 114 and 116 are connected to a third anticoincidence circuit 117, and stepped through to the OR gate 118 as UP and DOWN count pulses. The UP count pulse is additionally connected to the sign input Si terminal of the counter 71, such that when Si = 1 a Count up is provided and when Si = 0 a Count down is provided. The output of OR gate 118 is connected to the count enable CE terminal of the counter 71, and the short single-shot 119 from which the counter clock pulse C is derived. RESET and SET counter inputs are also provided for desired starting the pushing and catching process. Signals $\overline{RRS}$ or $\overline{HRS}$ are connected to terminal $\overline{R_D}$ for the pusher ram or hot car respectively for counter reset before starting the pushing and catching operation. At steady-state operation of the quench car, the UP and DOWN pulses will alternately by received at the counter input terminals, causing the counter to fluctuate about one count value or level.

Figure 9:
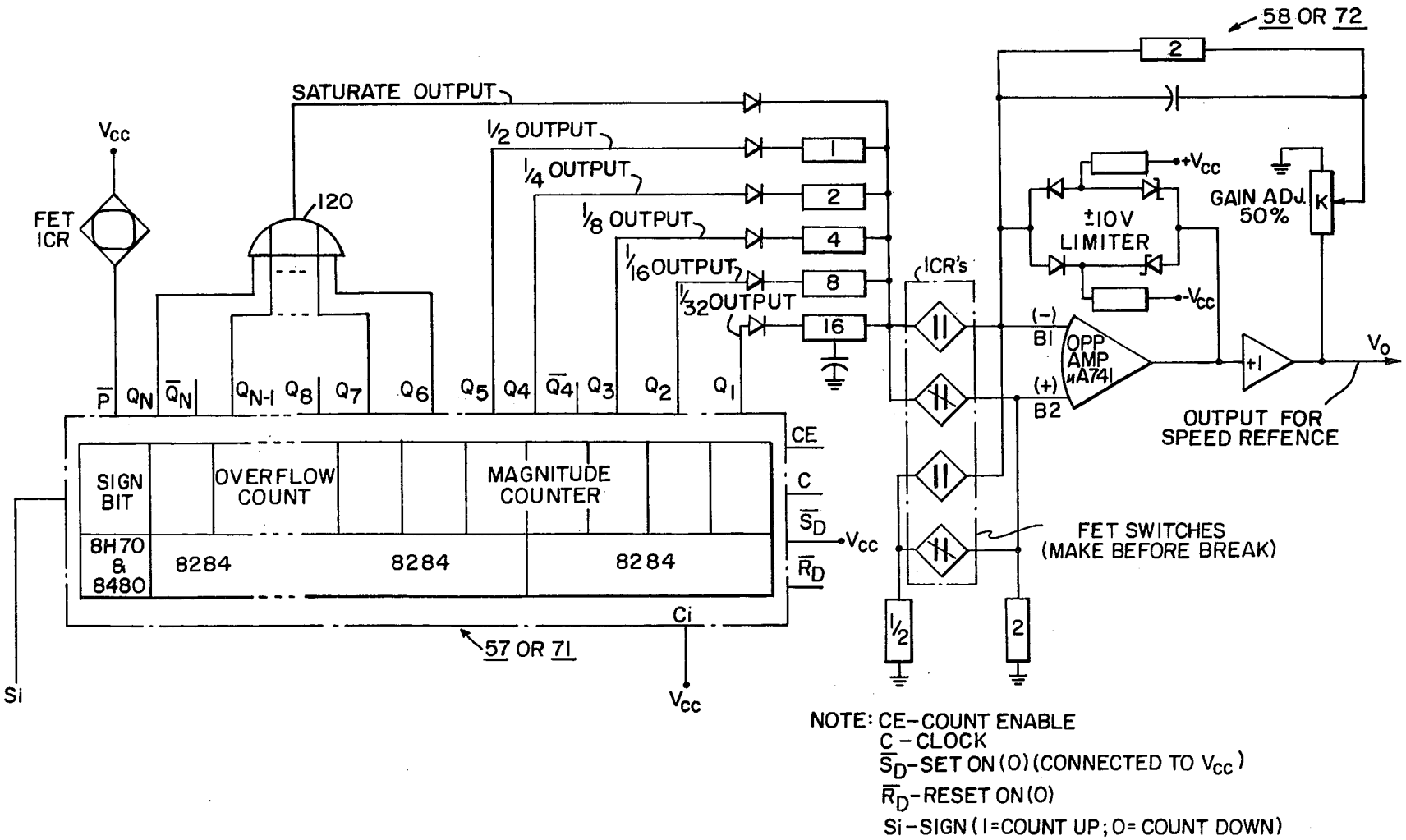
FIG. 9 is a schematic illustration of the position error counter and digital-to-analog converter apparatus utilized in FIG. 2.
Figure 10:
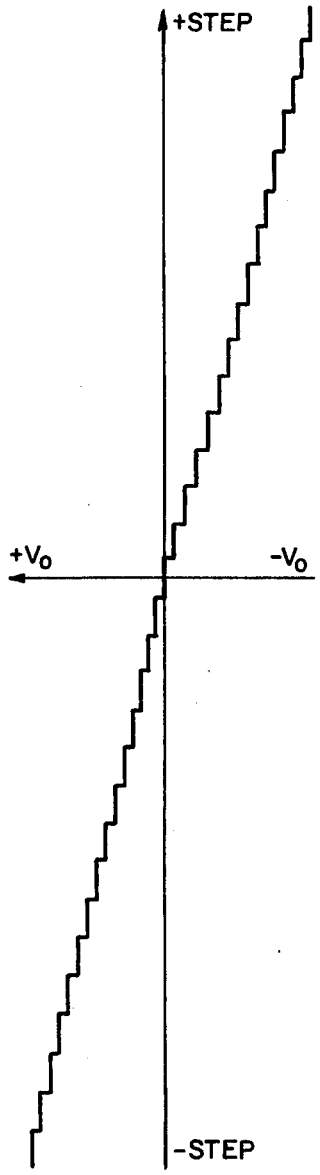
FIG. 10 illustrates the counter sequence code operation.

FIG. 9 illustrates the operation of the position error counter 71 and the digital-to-analog converter or summer 72 in more detail, as well as being an illustration for the position error counter 57 and converter 58. The circuit shown in FIG. 9 employs a magnitude counter with sign output $\overline{P}$ (= 0 for value ≧0; = 1 for value ≦0; transition in $\overline{P}$ occurs when magnitude goes from . . . 0000 to . . . 0001), such as is presently available as the SIGNETICS SYNCHRONOUS UP/DOWN hex COUNTER with 2's complement (style 8284) or equivalent and cascaded as shown. The counter output sequence operational code is shown in FIG. 10. The counter output stages $Q_n$ are connected to the input diodes and resistors of the summer 72. The output of the summer 72 is computed as, $$V_o = K\left(\underbrace{\sum_{n=1}^{N} \frac{2R}{2^{N-n}R} Q_n}_{\text{active count}} + \underbrace{\sum_{n>N}^{\infty} \frac{2R}{(\text{small})R} Q_n}_{\text{overflow count}}\right) * \left(-\overline{P}\right) \quad (8)$$

where $V_o$ consists of only those terms where $Q_n$ is (on) or set. Counts in the overflow range "greater than N" are connected through the OR gate 120 and will cause the summer to go into saturation, limited by the ± 10V LIMITER circuit. The gain constant K is provided for adjustment of $V_o$ output level which becomes the reference to the drive speed regulator. The sign output P is connected to the switching circuit 1CR, which circuit switches the polarity of the summer input circuit (B1⇄B2) to reverse $V_o$. Operational amplifier input balancing resistors are also included. The input diode assures $Q_n$ will go to zero when turned off. A step smoothing integrating capacitor is connected in parallel with the 2R feedback resistor. And a smoothing capacitor is provided in the $Q_1$ input resistor circuit to minimize steady-state count fluctuation or dither as described previously. An output power booster amplifier may also be required, as shown, for driving the speed regulator. The circuit is illustrated with 5 active counter output stages for a ± 32 step count, and 7 overflow output stages. This number of stages can be varied as desired by a person skilled in this art for the requirements of a particular drive application.

In the application illustrated each FWD or REV count represents a request for the drive to move one increment of displacement in the respective forward or reverse direction. The HR and HF counts indicate the drive has moved one increment in the opposite direction. The drive as illustrated will move along with a definite position error lag in the characteristic operation of a Type-0 control regulator with the lag being required to achieve an output from the summer, and deceleration travel when the drive is required to stop the progressive travel. The signal conditioner decoder logic, anticoincidence circuits, pulse generator, encoder counter, D/A converter, speed regulator, and tachometer are implemented substantially the same for both the coke transfer car and the pusher ram drives, as illustrated in FIG. 2.

The summer D/A converter 72 delivers a position control signal to a speed regulator 73, which regulator 73 is used to control the motor 70 of the locomotive and operatively coupled to the wheels thereof. The motor 70 is also mechanically coupled to a tachometer 74 providing a speed reference feedback loop signal to the speed regulator 73. As the coke transfer hot car 24 is indexed along the track 22 in relation to incremental movements of the pusher ram, the actual displacement of the coke transfer hot car is detected in the same manner as the actual displacement of the pusher ram, namely, that of providing a pulse generator 75 responsive to movement of the locomotive 25 and transfer hot car 24, such as being mechanically coupled to a non-driven wheel of the locomotive 25, to minimize loss of incremental position through wheel slippage or sloppy coupling. The output from the pulse generator 75 has the form of two separate pulse trains A and B which are received by an encoder 76 constructed in the same manner as the encoder 30 and already described in reference to FIG. 3. The output pulses from the encoder 76 are indicated in FIG. 2 as HP, HUD, HF and HR to denote actual movement of the coke transfer hot car 24 and the direction of the movement, respectively. The pulses generated by the encoder 76 are delivered to both a transmission amplifier 77 and to the logic apparatus 78, the latter forming a feedback signal to the counter 71 for use in a closed return loop control system preferably of an inner Type-1 speed regulating system and an outer Type-0 incremental position loop whereby the counter 71 is responsive to both the signal produced from the encoder 76 as well as the desired displacement signal provided by the signal conditioner 69 through the logic apparatus 78. The attenuation of the control signal produced by the digital-to-analog converter 72 is controlled by a potentiometer 79 having a movable slide wire and operative with the speed regulator 73.

The transmitting amplifier 77 delivers a signal to signal conditioner 80 in the same manner as already described in regard to the transmission of the signal by amplifier 68.

The signals H and HA go to hot car 24 to cause it to start moving at a rate corresponding to the movement of the pusher ram 17. The HP and HUD signals come back from the operation of the hot car locomotive 25, with the signal HUD indicating the direction of movement and HP indicating the rate at which the hot car 24 is moving. when the signal HP returns to the central controller 300, it changes for every 0.25 inch incremental movement of the hot car 24, with the JK flip-flop 652 and the exclusive OR 654 operating similarly to JK flip-flop 632 and exclusive OR 630 to generate pulse HP1 to increment the add/substract counter 81 in conjunction with the signal HUD in accordance with the actual position of the hot car 24.

The actual position HPI is compared in the subtractor comparator 656 with the desired position HRI. If the absolute value of HRI minus HPI is greater than the maximum position error HXE set by the operator thumbwheel 82, the output signal 510 becomes true to set the JK flip-flop 658, for indicating the hot car 24 is out of step. The output signal 660 from the JK flip-flop 658 is applied to NOR gate 93 to cause the pusher ram 17 to reverse in movement direction, with no repeated pounding action by the ram but instead the ram 17 now retracts out of the coke oven to avoid overheating the ram and the operator will now manually control the removal of coke from the particular coke oven involved at this time. The operator of the hot car locomotive 25 can cooperate with the operator of the pusher ram 17 to get the hot car 24 and the pusher ram 17 back into the required in step relationship.

The hot car 24 has to move in sequence corresponding to the movement of the pusher ram 17 for the automatic control of the pusher ram 17 and the hot car 24 as here described to continue. It is reasonable to assume that the locomotive motor 70 will not be overloaded by some obstacle along the locomotive track, such as is likely to have the motor 26 operative with the pusher ram 17 become overloaded by a sticking of the coke within the coke oven. If the locomotive is having some trouble, sutiable sensors can be included to detect this condition if desired or the locomotive opertor can modify the operation of the pusher ram to correctly sequence the pusher ram 17 with the operation of the hot car 24. It should be understood that the hot car 24 being out of step with the pusher ram 17 represents an abnormal operation of the hot car 24 and is not expected to be a common occurrence. When the pusher ram 17 arrives at its maximum forward limit RPX, the signal RPI will then become greater than the signal RPX, so the output signal 662 from the comparator 610 as applied to AND gate 608 will become false to shut off the forward pulse rate generator 90 and stop the forward movement of the pusher ram 17. At the same time the ram forwardmost position displacement RDI should become greater than RPX and this causes the comparator 646 to provide the signal 504 which causes the NOR gate 93 to change state and the pusher ram 17 then reverses its movement direction and backs up out of the coke oven. As the counter 63 stops counting, then the counter 62 will try to catch up with the counter 63, and if the drive has too much inertia it may be difficult for signals RP1 and RD1 to catch up entirely to signal RRI, and a bias might be desirable for the push is complete signal 504, to make the signal 504 become true and the ram 17 then backs up out of the coke oven. Also, the pusher ram operator could release the GO switch 603 at this time and the ram would back up out of the oven.

As optional speed monitoring apparatus for an operator or other observer trying to follow the provided process control operation, the respective rates of the positioning of the ram 17 and hot car 24 might be displayed. Thusly, the ram speed display 682 and the hot car speed display 684 and the elapsed time display counter 676 are shown. The clock pulse C is provided by a clock oscillator 668 operating with a 60 Hertz power supply 666. The clock pulses are provided at a constant rate of 240 pulses per second. A clock counter 670 is operative to count these clock pulses C and operates with comparator 672 to determine when the clock pulse count C is greater than or equal to a predetermined sample time CP of typically one second from an operator thumbwheel 674. The signal CT provided by the comparator 672 is used to increment the elapsed time counter 676 in seconds. While counter 670 is counting, the counter 678 is counting for the one second interval the pulses RP1 coming back from the ram 17 and the counter 680 is counting pulses HP1 coming back from the hot car 24 for the one second time interval. At the end of a second when the signal CT becomes true, the count of counter 678 is transferred to display 682 for the ram and the count of counter 680 is transferred to display 684 for the hot car. A reset of counters 678 and 680 occurs at this time. Thusly, every second the display 682 shows the average speed of the ram for one second and the display 684 shows the average speed of the hot car for one second. The position movement integration for one second of the ram is accomplished by the counter 678 in response to the signals RP1 and RUD, and the position movement integration for one second of the hot car is accomplished by the counter 680 in response to the signals HPI and HUD. It should be noted that the source of clock pulse C must be faster than the highest expected rate of any of the signals RA1, RP1, and HP1.

As explained previously, the logic apparatus 56 and 78 provide pulse signal inputs for an outer Type-0 incremental position loop, and an inner Type-1 speed regulating loop for the coke transfer car drive, which operates toward maintaining a zero speed error with a definite position lag in regard to both the pusher ram 17, and the coke transfer car 24. The central controller 300 provides in addition to these Type-1 and Type-0 control system operations, signals which feed back the actual coke transfer car position signal to the pusher ram as well as the actual pusher ram position signal for controlling the coke transfer car.

It will be apparent to those skilled in the art that the control system has been illustrated and described in relation to the generation of pulses to represent position changes of the ram for controlling like position changes in the coke transfer car. It is preferred to provide a digital transmission system wherein the transmission rate of pulses may be relatively slow, thus enabling the use of lower frequency communication between the pusher ram which is physically located at one side of the coke oven and the coke transfer hot car which is located at the other side of the coke oven. Such a low transmission rate improves the signal-to-noise ratio on the transmission lines by providing longer sampling time. This also allows the central controller 300 to be used for performing other functions in the interim period. The use of the present position regulating system allows for immediate slow down of the coke transfer hot car as the ram begins to slow down since the lag error in the position regulator immediately begins to decrease. There is a further advantage to this position regulating system, namely that of providing a continuous and stepless speed control of the coke transfer hot car consistent with the ram speed after initial acceleration.

Figure 14:
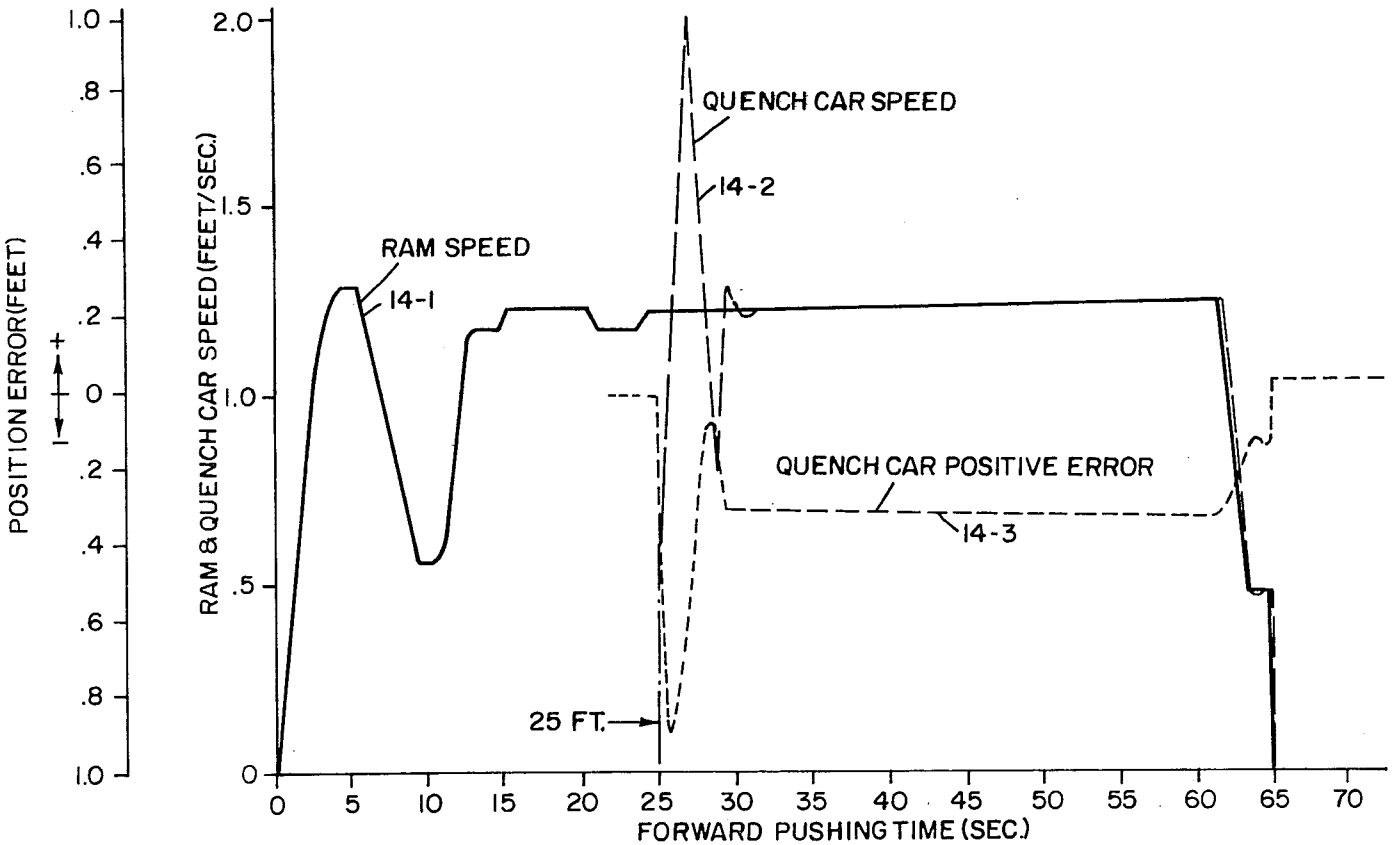
FIG. 14 illustrates in graphic form a typical transfer hot car movement in relation to movement of the pusher ram.

As shown in FIG. 14, the pusher ram 17 initially accelerates to approximately ½ full speed, which is the normal pushing speed, while the pusher ram retraction is at full speed of approximately 2.25 ft./sec. As the pusher ram approaches the open oven door it slows to ¼ full speed, and makes its entrance, and then it accelerates back to ½ full speed for the remainder of the push. Variations in speed are caused by load changes of the pusher ram during pushing, such as impact with coke, compression, stickers, etc., and removal of load as coke falls off into the hot car. Toward the end of forward stroke, the pusher ram again slows to ¼ speed as it approaches the final end stop. When the pusher ram reaches a forward position of about 25 feet, the hot car forward operation begins. Lagging position error builds up very rapidly initially, since the hot car is at zero speed, and the pusher ram is already at normal pushing speed. To overcome this position error build-up, the hot car speed must exceed the pusher ram speed until the hot car reaches ram speed, and exceeds it, when the error build-up holds and begins to decrease. The hot car continues to increase in speed until the position regulator reaches its normal lag of approximately ⅓ foot (at ½ ram speed). While this large speed mismatch is decreasing, the position error further decreases and causes a secondary undershoot in hot car speed, which is quickly recovered as error builds up again to its normal position. From this point on the hot car follows ram motion very closely, with only slight variation as the ram speed varies and finally stops.

FIG. 14 illustrates a typical operational relationship between the pusher ram speed as shown by curve 14-1 and the quench car speed as shown by curve 14-2, with the quench car position error in tenths of a foot being shown by curve 14-3. For the first 25 seconds of pushing time the coke is compressing and moving through the coke guide, with the quench car initially accelerating rather rapidly to catch up with the movement of the pusher ram and then synchronously following the movement of the pusher ram.

In FIG. 15, the loss of feedback signals is the loss of quench car speed reference signal HA and the loss of quench car speed feedback signal HP.

In past apparatus for controlling the ram, there are limit switches operative with the ram to cause the speed controller to run the ram at different speeds as the ram progresses forward, such that successive limit switches as tripped operate to change the speed reference for the pusher ram speed control apparatus. Here, the central controller instead runs the ram by indicating the actual ram position and a desired position in relation to the actual position of the ram, and there will still be limit switches provided to be tripped as the ram moves through its intended path to try to follow what the ram is doing. The limit switches could override the control signals R and RA from the central controller 300, and such overriding might cause counters 63 and 62 and the comparator 622 to modify their operation as a backup control operation for the pusher ram 17.

The speed regulator, ram, tachometer and gearing are already presently well known in prior art skill. The pulse tachometer 29 is new to coke oven operation but known in the art of digital control, the D/A converter, the counter and the logic, the pulse encoder and the communication channels would have to be added to the pusher apparatus control 650 (and same for control 652 relative to hot car 24). The limit switches can be operated by a circular cam moving with the pusher ram 17 and off the outboard end of shaft of motor 26.

The following symbol designations have been utilized in the here provided disclosure of the present invention.

Figure 15A:
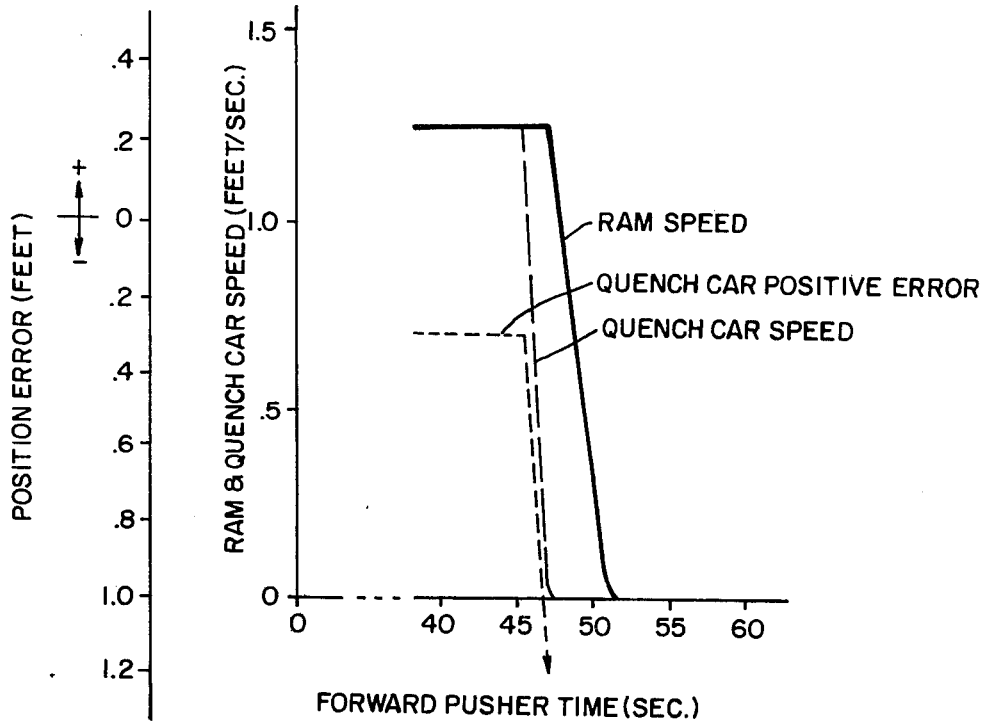
FIG. 15 illustrates in graphic form the behavior of the quench car when as shown in 15A the speed reference signal HA is lost and when as shown in 15B the speed feedback signal HP is lost.
Figure 15B:
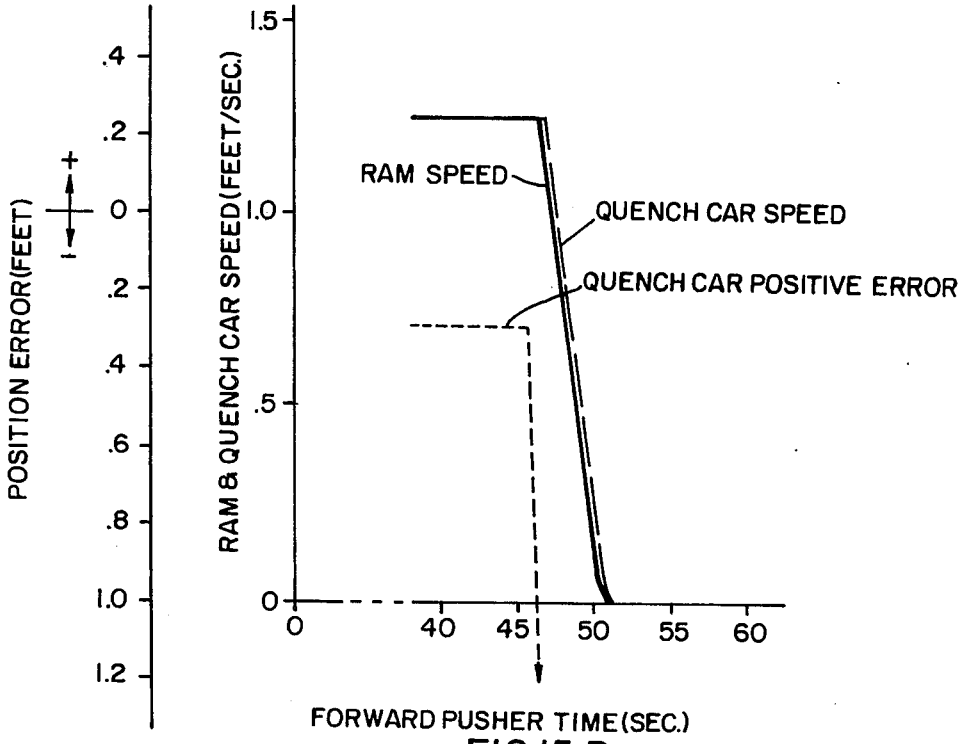

T = Total Elapsed Time In Seconds
RRS = Reset Pulse For Pusher Ram Controller
R = Ram Output Movement (T=Forward, F=Reverse)
RA1 = Ram Output Pulse (Pulse Rate:To Speed)
RA = Ram Output Speed (Change Rate:To Speed)
RRI = Ram Reference Position In Inches
RPN = Ram Reverse Min. Limit In Inches (RPN = 0.0)
RPX = Ram Forward Max. Limit In Inches (RPX >>RPN, Approx. 50 Ft.)
RXE = Ram Max. Position Error In Inches (Approx. 1 Ft.)
RP = Pusher Ram Input Movement Pulse (Each Change In RP = 0.25 Inches)
RQ = The State of Last Input Pulse RP
RP1 = Exclusive .OR. Of RP And RQ
RUD = Pusher Ram Input Direction (T=Forward, F=Reverse)
RPI = Ram Position In Inches
ROOS = Ram Out-Of-Step
RDI =Ram Forwardmost Position In Inches
RDP = Ram Forward Position To Start Quench Car In Inches (Approx. 25 Ft.) Value Combines Coke Compression And Movement Through Guide
RSC = Ram Speed Counter In Inches/Second
RSF = Ram Speed In Feet/Second
RNSP = Ram Rev. (If. False.). Indicates Ram Or Quench Car Position Is One Foot Or More Out Of Required Step, Or Operator Stop Interrupt
HRS = Reset Pulse For Quench Car Controller
H = Quench Car Output Movement (F=Stop, T=Forward) H=(S.Stop.G.Go)
HA1 = Quench Car Output Pulse (Pulse Rate:To Speed)
HA = Quench Car Output Speed (Change Rate:To Speed)
HRI = Quench Car Reference Position In Inches
HXE = Quench Car Max. Position Error In Inches (Approx. 1 Ft.)
HP = Quench Car Input Movement Pulse (Each Change In HP =0.25 Inches)
HQ = The State Of Last Input Pulse HP
HP1 = Exclusive .OR. Of HP And HQ
HUD = Quench Car Input Direction (T=Forward, F=Reverse)
HPI = Quench Car Position In Inches
HOOS = Quench Car Out-Of-Step
HSC = Quench Car Speed Counter In Inches/-Second
HSF = Quench Car Speed In Feet/Second
C = Clock (Cycle = 1/240th Of Sec)
CP = Clock Sample Period In FIG. 15 there is illustrated the drive control system operation when the movements of the quench car and the pusher ram get out of sequence. In FIG. 15A the behavior of the quench car is illustrated when the input signal HA is lost for some reason. In FIG. 15B the response of the quench car is illustrated when the feedback signal HP is lost for some reason.

Figure 16A:
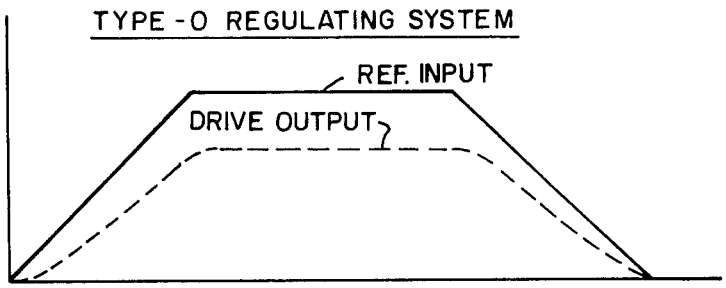
FIG. 16 illustrates in graphic form the operating characteristics of well known prior art regulating systems, with 16A showing the behavior of a Type-O regulating system, with 16B showing the behavior of a Type-1 regulating system and with 16C showing the behavior of a Type-2 regulating system.
Figure 16B:
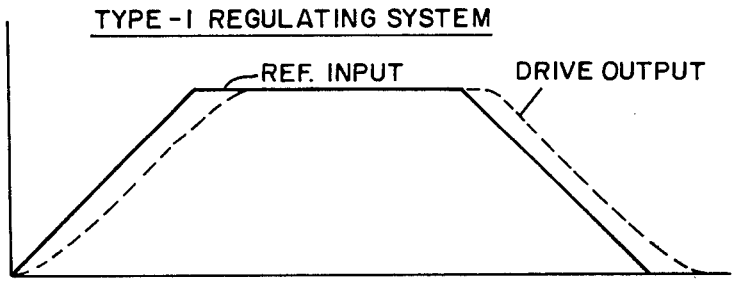
Figure 16C:
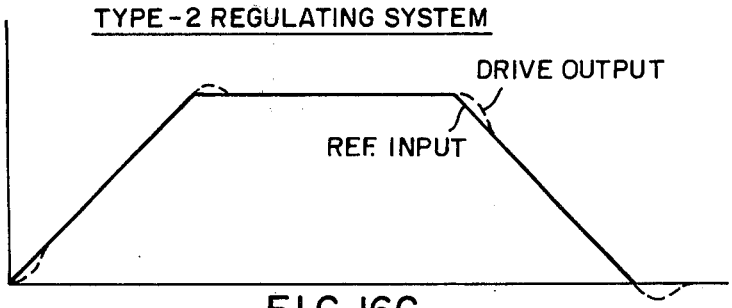

As described in a 1960 book published by McGrawHill Book Company and entitled Principles of Control System Engineering by Vincent Del Toro and Sydney R. Parker, a Type-0 regulating system is characterized by following a steady-state reference signal with a definite error proportional to the magnitude of the reference signal as shown in FIG. 16A, and a ramping reference signal with an error proportional to the square of rate of change of the reference signal. A Type-1 regulating system is characterized by following a steady-state reference signal with zero error as shown in FIG. 16B, and a ramping reference signal with a definite error proportional to the rate of change of the reference signal. A Type-2 regulating system is characterized by following steady-state and ramping reference signals with zero error as shown in FIG. 16C, however, during discontinuities of the reference signal (i.e. changing from steady-state to ramping, or ramping to steady-state) an error will exist proportional to the rate of the discontinuity change.

CONTROL SYSTEM COMPONENTS

POSITION ERROR COUNTER - (ITEMS 57 or 71 in FIGS. 2 and 9)

SIGNETICS SYNCHRONOUS UP/DOWN COUNTER
(DLM Application Memo, p. 3–93, 1973)
Includes:
(3) style 8284 4 bit U/D counter
(1) style 8480 4 bit-2 input NANDs
(1) style 8H70 3-3 input ANDs

UP/DOWN COUNTER (PRE-SETTABLE TYPE)

(ITEMS 63, 62, 61, 67, 81, 676, 670 in FIG. 2).

TEXAS INSTRUMENTS SYNCHRONOUS COUNTER (The TTL Data Book for Design Engineers 1973, p. 418)
Includes:
(4) style SN74191 4-bit U/D counter with data preset UP-COUNTER (ZERO RESET) - (ITEMS 678, 680 in FIG. 2)

TEXAS INSTRUMENTS SYNCHRONOUS COUNTER (The TTL Data Book for Design Engineers 1973, p. 418)
Includes:
(4) style SN74191 4-bit U/D counter with data preset SUMMER/SUBTRACTOR - PART OF ITEMS 622, 644, 656 in FIG. 2)

TEXAS INSETRUMENTS ARITHMETIC LOGIC UNITS (The TTL Data Book for Design Engineers 1973, p. 383, 395)
Includes:
(4) style SN74181 4-bit address
(1) style SN74182 4-bit look ahead carry generators COMPARATOR - (ITEMS 638, 622, 626, 610, 644, 642, 646, 648, 656, and 672 in FIG. 2)

TEXAS INSTRUMENTS MAGNITUDE COMPARATORS (The TTL Data Book for Design Engineers 1973, p. 208)
Includes:
(4) style SN7485 4-bit comparator GANGED AND GATE - (ITEMS 614, 618, 628, 655 in FIG. 2)

TEXAS INSTRUMENTS MAGNITUDE DATA SELECTORS (The TTL Data Book for Design Engineers 1973, p. 318)
Includes:
(4) style SN74157 4-bit selectors.

I claim:

1. A control system for providing incremental position regulation of a first apparatus in relation to the positional movement of a second apparatus, including the combination of, means for providing a position control signal in accordance with the desired position of said first apparatus, means responsive to said position control signal for providing first signal pulses at a first rate for controlling the actual positonal movement of said first apparatus means responsive to said first signal pulses for providing second signal pulses at a second rate in accordance with the desired positional movement of said second apparatus, means responsive to the actual positional movement of said second apparatus for providing third signal pulses in accordance with said actual positional movement of said second apparatus, and means responsive to said second signal pulses and said third signal pulses for controlling the actual positional movement of said second apparatus.

2. The control system of claim 1, including means responsive to the actual positional movement of said first apparatus for providing fourth signal pulses in accordance with the actual positional movement of said first apparatus, and means responsive to said first signal pulses and to said fourth signal pulses for controlling the actual position of said first member.

3. In a control system for providing incremental position regulation between the movement of a coke transfer car along a track in relation to the coke discharge side of a given coke oven chamber and the movement of a coke pusher advancing through that coke oven chamber from the opposite side thereof the push the coke into said car for providing a substantially uniform layer of coke in said car, said control system comprising:

first means for generating first signal pulses at a predetermined pulse rate in accordance with the desired position of said ram, second means responsive to said first signal pulses for producing second signal pulses in accordance with the desired position of said coke transfer car along said track, third means responsive to said second signal pulses for moving said coke transfer car along said track, fourth means for generating third signal pulses in accordance with the actual position of said coke transfer car along said track, and with said third means being responsive to said third signal pulses for modifying the position of said coke transfer car along said track.

4. The control system according to claim 3 further comprising means responsive to said first pulses for producing a fourth signal which varies as a function of the actual forwardmost position of said pusher ram.

5. The control system according to claim 3 further comprising means responsive to said first signal pulses to control advancement of said ram in a forward direction for pushing coke from said oven chamber into said coke transfer car.

6. The control system according to claim 3 further comprising means controlling the production of said second signal pulses to inhibit movement of said coke transfer car until after a predetermined forward displacement of said ram in a direction toward said coke transfer car.

7. The control system according to claim 3 further comprising means biasing the response of said third means to said second signal pulses according to a predetermined position lag error signal in a manner that position changes representing the desired actual advancement of said coke transfer car along said track have a predetermined lag behind the actual advancing movement of said ram in the direction toward the coke transfer car.

8. The control system according to claim 3 further including control means responsive to said first signal pulses for moving said ram relative to said coke transfer car.

9. The control system according to claim 8 further comprising means for modifying the pulse rate of said first signal pulses to control the speed at which said ram moves in the direction toward said coke transfer car.

10. The control system according to claim 8 further comprising means for modifying the pulse rate of said first signal pulses to control the speed at which said ram moves in the direction away from said coke transfer car.

11. The control system according to claim 8 further comprising means for modifying the pulse rate of said first signal pulses to control the speed at which said ram is retracted from said given coke oven chamber following the discharge of coke therefrom.

12. The control system according to claim 8 further comprising means for modifying said first signal pulses to control the displacement of said ram in response to the actual position of said ram transfer car.

13. The control system according to claim 3 further comprising means responsive to the difference between the desired position of said ram and the actual position of said ram for inhibiting further positional movement of said ram when said difference exceeds a predetermined position error.

14. The control system according to claim 3 wherein said first means for generating first signal pulses includes:

a pulse generator for producing a train of first signal pulses having a pulse rate responsive to the positional movement of said ram.

15. The control system of claim 3, including means for producing a pulse output signal indicative of actual positional movement of said ram; and fifth means responsive to said first signal pulses and said pulse output signal for controlling the actual position of said ram.

16. The control system according to claim 3 with said third means including:

a resettable counter responsive to said second signal pulses for producing an electrical signal corresponding to the desired position of said coke transfer car, and means for biasing said electrical signal from said resettable counter to produce output pulses representing a predetermined position lag of said coke transfer car in relation to the position of said ram.

17. The control system according to claim 3 with said third means including a resettable counter responsive to said second signal pulses and said third signal pulses for controlling the movement of the coke transfer car along said track.

18. The control system according to claim 3 with said third means for moving said coke transfer car including:

a drive motor operative with said transfer car, a speed regulator operative with said drive motor and responsive to said second signal pulses, and means for attenuating the response by said speed regulator to said second signal pulses.

19. The control system according to claim 3 with said fourth means for generating a third signal including:

a pulse generator for producing two trains of phase displaced pulses in response to movement of said coke transfer car along said track, encoder means for modifying said phase displaced pulses for producing two trains of pulses in phase opposition to each other, means responsive to said two trains of pulses in phase opposition for producing a pulse output indicative of the actual movement of said coke transfer car; and means including a timer for receiving said two trains of pulses in phase opposition to produce a pulse output indicative of the displacement direction of said coke transfer car along said track.

20. The control system according to claim 19 further including:

resettable counter means including a logic circuit responsive to the two trains of pulses from said encoder means to generate said third signal pulses.

21. The control system according to claim 3 further including:

a drive motor coupled with said pusher ram for displacing said ram through said given coke oven chamber, resettable counter means including a logic circuit for producing a control signal representing a desired displacement of said ram, a speed regulator responsive to said control signal for controlling said drive motor, and means for attenuating the response by the speed regulator to said control signal.

22. The control system according to claim 3 including a said speed regulator further responsive to said first pulses.

23. The method of controlling the incremental position regulation of a first apparatus in relation to the positional movement of a second apparatus, including the steps of:

providing first control signal pulses at a rate in accordance with the desired positional movement for said first apparatus, controlling the actual movement of said first apparatus in response to said first control signal pulses, providing second control signal pulses in response to said first control signal pulses and in accordance with the desired positional movement of said second apparatus, providing third control signal pulses in response to the actual positional movement of said second apparatus, and controlling the actual movement of said second apparatus in response to at least one of said second control signal pulses and said third control signal pulses.

24. The method of controlling the movement of a coke transfer car along a track at the coke discharge side of a coke oven chamber in a synchronous relation with the movement of a pusher ram to advance through that coke oven chamber from the opposite side thereof to push coke into said car and form a substantially uniform layer of coke therein, said method including the steps of:

providing first signal pulses at a predetermined rate for advancing the ram into contact with the coke at one side of the oven chamber and to inhibit the initial movement of said coke transfer car relative to the oven chamber, providing second signal pulses in response to said first signal pulses for advancing the coke transfer car along said track in relation to further advancing movement of said ram through said coke oven chamber, maintaining movement of the car along the track in a position relationship dependent upon continued forward advancement of said ram through said coke oven chamber, and terminating the movement of the car along said track when the ram discontinues said forward advancement through the coke oven chamber.

25. The method of claim 24 including the further step of:

controlling the movement of said car along the track in response to said second signal pulses to maintain a predetermined position error in relation to the desired displacement of said car and proportional to the speed of said car.

26. The method of claim 24 including the further step of:

controlling the forward advancement movement of said ram through said coke oven chamber in response to said first signal pulses to maintain a predetermined position error in relation to the desired continued advancement of said ram and proportional to the said ram speed.

27. The method of claim 24 including the step of maintaining a predetermined position lag error of said coke transfer car in response to said second signal pulses and in relation to forward advancement movement of said ram through the oven chamber.

* * * * *